US009588480B2

(12) United States Patent
Fukuchi et al.

(10) Patent No.: US 9,588,480 B2
(45) Date of Patent: Mar. 7, 2017

(54) IMAGE FORMING APPARATUS

(71) Applicant: Brother Kogyo Kabushiki Kaisha, Nagoya-shi, Aichi-ken (JP)

(72) Inventors: Isao Fukuchi, Gifu (JP); Atsushi Fukui, Toyota (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/273,575

(22) Filed: May 9, 2014

(65) Prior Publication Data

US 2014/0334842 A1 Nov. 13, 2014

(30) Foreign Application Priority Data

May 9, 2013 (JP) ..... 2013-099440

(51) Int. Cl.
*G03G 21/10* (2006.01)

(52) U.S. Cl.
CPC ... *G03G 21/105* (2013.01); *G03G 2215/0141* (2013.01)

(58) Field of Classification Search
CPC ..... G03G 2221/1684; G03G 21/16; G03G 21/105
See application file for complete search history.

(56) References Cited

U.S. PATENT DOCUMENTS 7,426,365 B2 9/2008 Uchihashi
7,865,092 B2 * 1/2011 Murata ..... G03G 21/12 399/35
8,270,891 B2 9/2012 Ogashiwa
8,583,023 B2 11/2013 Yuasa
2005/0220515 A1 10/2005 Wakana
2005/0226658 A1 * 10/2005 Haruyama ..... 399/258
(Continued)

FOREIGN PATENT DOCUMENTS

JP 2006-162941 A 6/2006
JP 2008-052033 A 3/2008
(Continued)

OTHER PUBLICATIONS

Oct. 25, 2016—(JP) Notification of Reasons for Rejection—App 2013-099440.

*Primary Examiner* — Clayton E Laballe
*Assistant Examiner* — Noam Reisner
(74) *Attorney, Agent, or Firm* — Banner & Witcoff, Ltd.

(57) ABSTRACT

An image forming apparatus has a main body, a belt unit configured to accommodate a belt, a belt cleaning member and an accommodating unit. The belt cleaning unit is configured to remove waste toner adhered on the belt. The accommodating unit is configured to accommodate the toner removed by the belt cleaning unit. The apparatus further includes a drum unit having a drum cleaning member, and a waste toner conveying mechanism configured to convey the waste toner to the collecting unit. The conveying mechanism has a drum-side conveying unit configured to be connected with the drum cleaning member. Communication between the drum-side conveying unit and the collecting unit is enabled in association with movement of the drum unit from the outside position to the inside position, and disabled in association with movement of the drum unit from the inside position to the outside position.

18 Claims, 11 Drawing Sheets

(56) References Cited

U.S. PATENT DOCUMENTS

| | | | | |
|---|---|---|---|---|
| 2006/0120779 | A1 | 6/2006 | Uchihashi | |
| 2008/0240779 | A1 | 10/2008 | Ogashiwa | |
| 2010/0074646 | A1 | 3/2010 | Miyahara et al. | |
| 2011/0044743 | A1 | 2/2011 | Yuasa | |
| 2013/0136488 | A1 | 5/2013 | Yoshikawa | |
| 2013/0251433 | A1* | 9/2013 | Toshiyuki | 399/358 |
| 2014/0321896 | A1* | 10/2014 | Morishita | 399/358 |

FOREIGN PATENT DOCUMENTS

| | | | |
|---|---|---|---|
| JP | 2008-242165 | A | 10/2008 |
| JP | 2010-078848 | A | 4/2010 |
| JP | 2010-160522 | A | 7/2010 |
| JP | 2010-266897 | A | 11/2010 |
| JP | 2011-043568 | A | 3/2011 |
| JP | 2013-137494 | A | 7/2013 |

* cited by examiner

UP
REAR
FRONT
DOWN

UP
DOWN
FRONT
REAR

IMAGE FORMING APPARATUS

CROSS-REFERENCE TO RELATED APPLICATION

This application claims priority under 35 U.S.C. §119 from Japanese Patent Applications No. 2013-099440 filed on May 9, 2013. The entire subject matter of the application is incorporated herein by reference.

BACKGROUND

Technical Field

Aspects of the present invention relate to an image forming apparatus employing an electrophotographic image forming method.

Conventional Art

Conventionally, as an example of the electrophotographic image forming apparatus, there has been known a so-called tandem type color printer which has a plurality of photoconductive drums corresponding to a plurality of colors (e.g., yellow, magenta, cyan and black).

It is generally known that, in such a tandem type color printer, waste toner adhered on the photoconductive drums is removed by toner collecting units, and the removed toner is conveyed to a container which is typically arranged at a lower section of the printer.

Specifically, the waste toner on each of the photoconductive drums is scraped and removed with a cleaning blade of the toner collecting unit. Then, the waste toner is conveyed toward one axial end portions of the photoconductive drums with use of auger screws, respectively. The toner collected at one side end portions of the photoconductive drums falls down, with its own weight, from the toner collecting unit to a toner conveying unit, and is further conveyed to the collection container and accumulated therein.

As above, the waste toner adhered on the plurality of photoconductive drums is conveyed downward by its own weight, without being caused to proceed against a direction of gravitation force.

SUMMARY

In the conventional color printer as described above, the plurality of process units respectively including the photoconductive drums are connected to a toner conveying section via toner introduction units respectively corresponding to the plurality of process units. The toner scraped from the plurality of photoconductive drums should be caused to fall onto the toner conveying section. Therefore, there are a plurality of connections at which the toner collection sections respectively corresponding to the plurality of photoconductive drums are connected to the toner conveying section, which may results in a complicated structure.

In consideration of the above, aspects of the invention provided an improved image forming apparatus configured such that waste toner adhered on the plurality of photoconductive drums is scraped and conveyed to a toner collecting unit with a relatively simple structure.

According to aspects of the invention, there is provided an image forming apparatus configured to form an image on a photoconductive drum. The image forming apparatus is provided with a main body, a belt unit configured to accommodate a belt, a belt cleaning member and an accommodating unit. The belt cleaning unit is configured to remove waste toner adhered on a belt, the accommodating unit is configured to accommodates the waste toner removed by the belt cleaning. The image forming apparatus further includes a drum unit having a drum cleaning member, which is configured to remove waste toner adhered on a photoconductive drum. The drum unit is configured to be movable between an inside position which is inside the main body and an outside position which is outside the main body. The image forming apparatus further includes a conveying mechanism configured to convey the waste toner removed from the photoconductive drum by the drum cleaning member to the collecting unit. The conveying mechanism has a drum-side conveying unit configured to be connected with the drum cleaning member. Communication between the drum-side conveying unit and the accommodating unit is enabled in association with movement of the drum unit from the outside position to the inside position, and communication between the drum-side conveying unit and the accommodating unit is disabled in association with movement of the drum unit from the inside position to the outside position.

According to the above configuration, waste toner adhered on one or a plurality of photoconductive drums can be scraped and conveyed to a toner accommodating unit with a relatively simple structure.

BRIEF DESCRIPTION OF THE ACCOMPANYING DRAWINGS

FIG. 6A shows a state where a connection between the conveying unit and the belt cleaning unit is released; and FIG. 6B shows a state where the conveying unit and the belt cleaning unit are connected.

FIG. 7A shows a state where the connection between the process-side conveying tube and the casing-side conveying tube is released, and FIG. 7B shows a state where the process-side conveying tube and the casing-side conveying tube are connected.

Figure 10A:
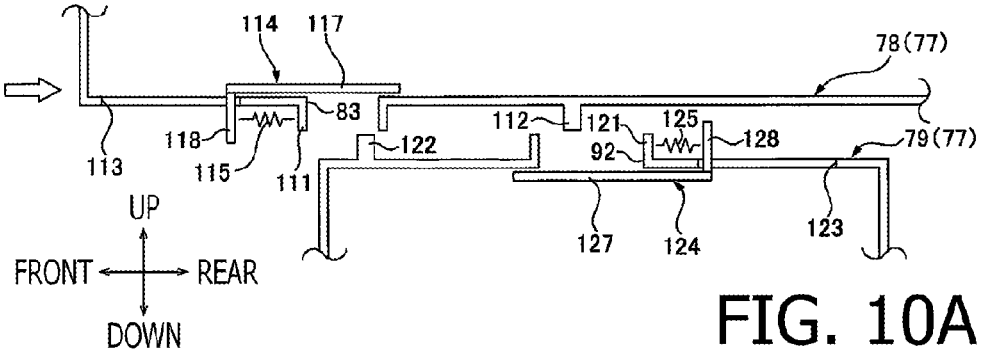
Figure 10B:
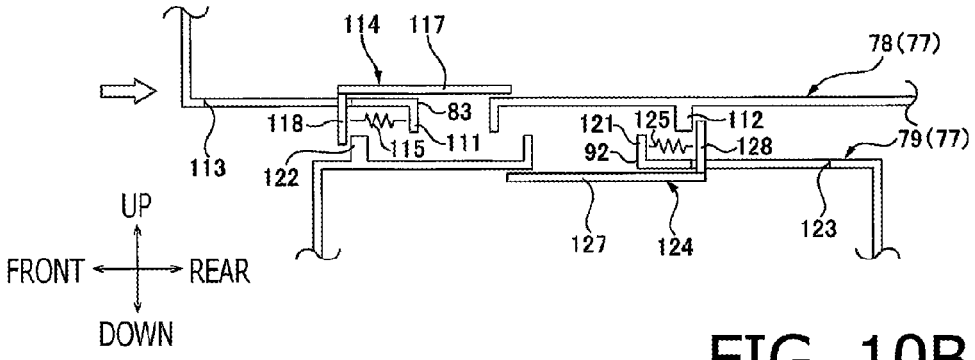
Figure 10C:
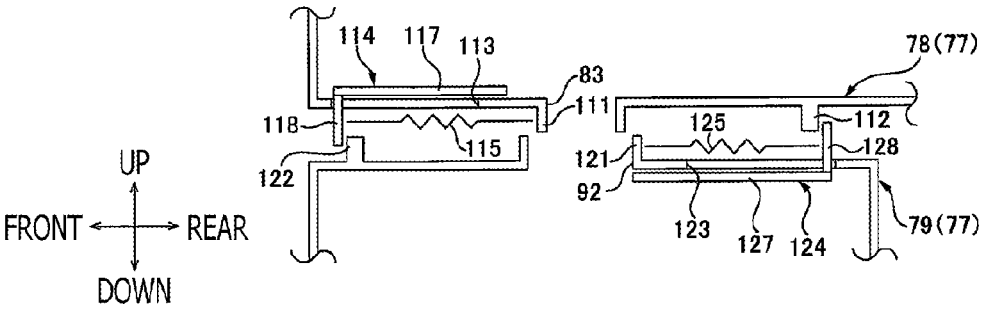

FIGS. 10A, 10B and 10C illustrate a connection between the process-side conveying tube and the casing-side conveying tube of the conveying mechanism according to a third embodiment of the invention. Specifically, FIG. 10A shows a state where the connection between the process-side conveying tube and the casing-side conveying tube is released, FIG. 10B shows a state where the process-side conveying tube and the casing-side conveying tube are one a way of being connected, and FIG. 10C shows a state where the process-side conveying tube and the casing-side conveying tube have been connected.

Figure 11A:
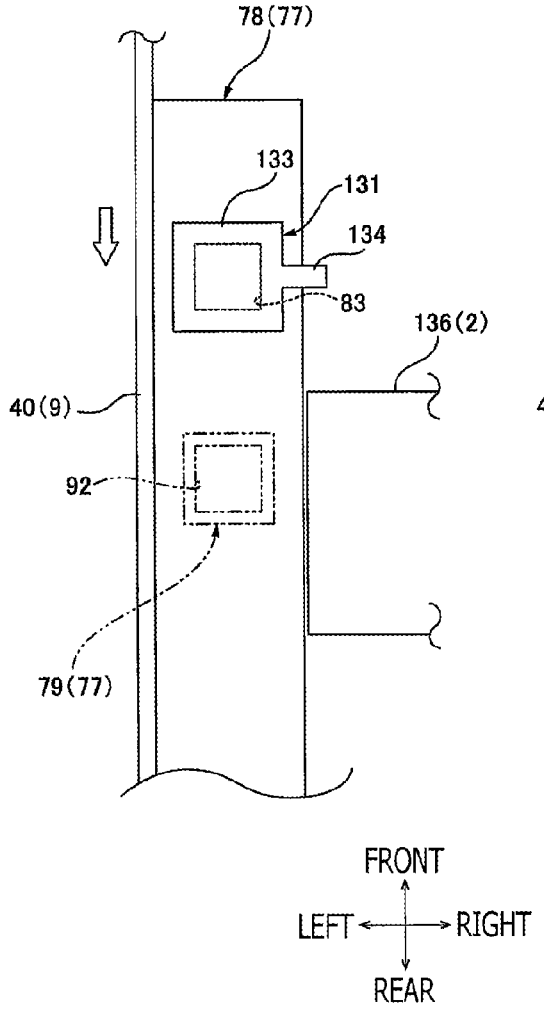
Figure 11B:
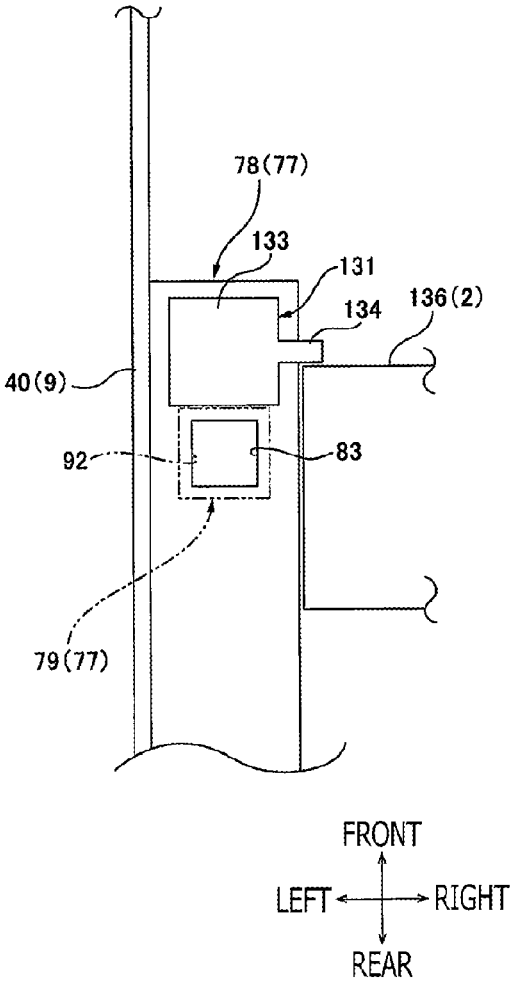

FIGS. 11A and 11B show a connection between the process-side conveying tube and the casing-side conveying tube of the conveying mechanism according to a fourth embodiment of the invention. Specifically, FIG. 11A shows a state where the connection between the process-side conveying tube and the casing-side conveying tube is released, and FIG. 11B shows a state where the process-side conveying tube and the casing-side conveying tube have been connected.

DETAILED DESCRIPTION OF THE EMBODIMENTS

Overall Configuration of Printer

A printer 1 according to aspects of the invention is a so-called direct tandem type color laser printer which is placed horizontally.

Figures 1A, 1B:
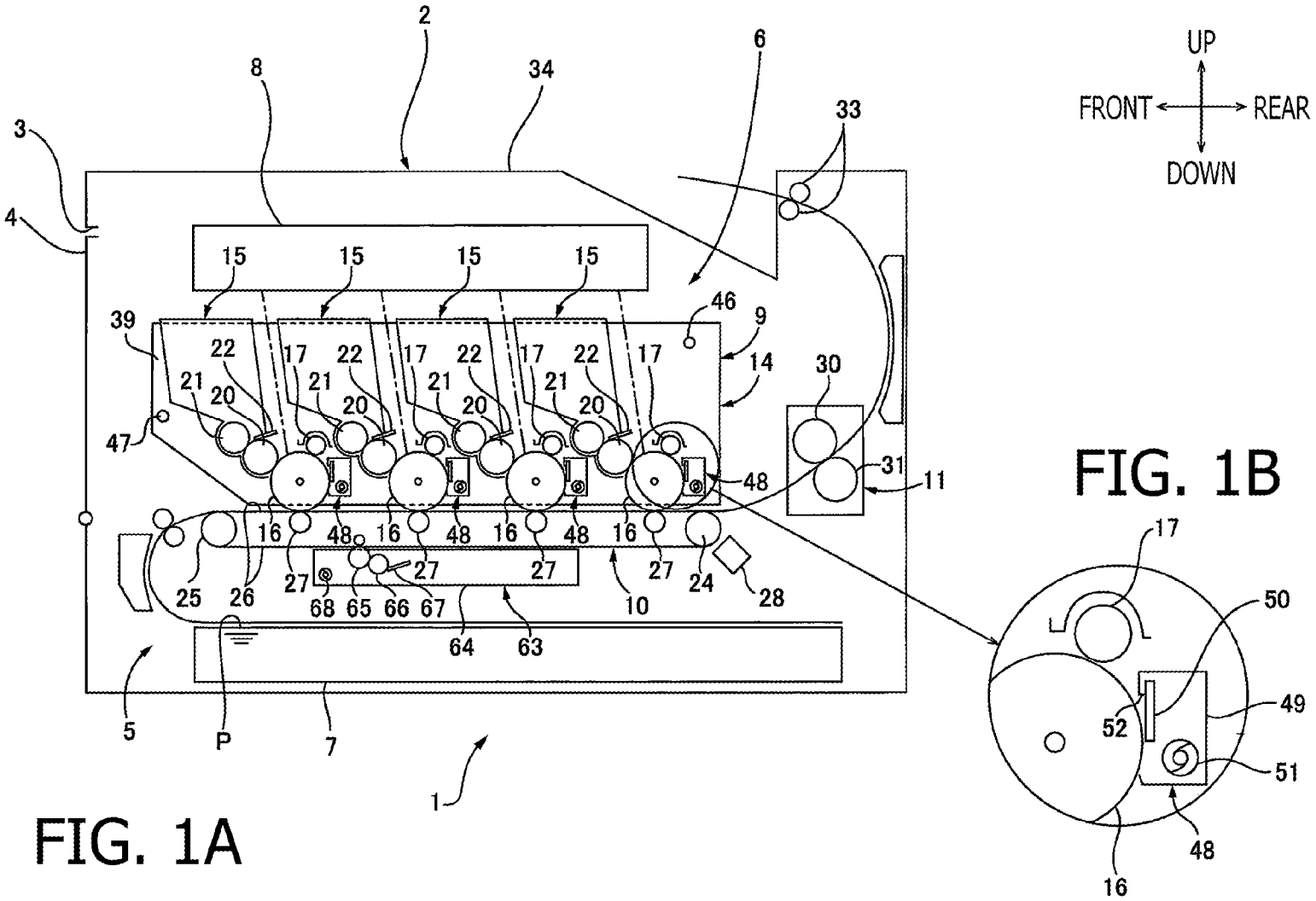
FIG. 1A is a cross sectional side view schematically showing an image forming apparatus according to aspects of a first embodiment of the invention.
FIG. 1B is enlarged partial view of the cross sectional view shown in FIG. 1A.

In the following description, when directions with respect to the printer 1 are referred to, the directions for a user when the printer 1 is placed horizontally will be used. For example, in FIG. 1A, up and down direction of FIG. 1A are the up and down direction of the printer 1. Further, front and rear direction of the printer 1 are a right-hand direction and a left-hand direction of FIG. 1A, respectively. Right and Left directions are indicated with reference the directions when the printer 1 is viewed from its front side. Therefore, a direction perpendicular to a plane of FIG. 1A is a right-and-left direction of the printer 1. Specifically, a further side with respect to the plane of FIG. 1A is a left direction of the printer 1, and a nearer side with respect to the plane of FIG. 1A is a right direction of the printer 1.

First Embodiment

The printer 1 has a casing 2. The casing 2 has a box-like shape. The casing 2 has an opening 3 and a front cover 4. The front cover 4 is configured to be rotatable about an axis located at an lower end thereof, and rotatable between a closing position at which the front cover 4 closes the opening 3, and an open position at which the opening 3 is opened 3.

The casing 2 accommodates a feeding unit 5 and an image forming unit 6. The feeding unit 5 has a sheet feed tray 7 and a plurality of rollers. The sheet feed tray 7 is arranged at a lower part inside the casing 2, and configured to accommodate sheets P. The plurality of rollers of the feeding unit 5 are arranged at an upper front of the sheet feed tray 7. The plurality of rollers of the feeding unit 5 are configured to feed the sheets P toward the image forming unit 6.

The image forming unit 6 includes a scanner unit 8, a process unit 9, a transfer unit 10 and a fixing unit 11.

The scanner unit 8 is arranged at an upper portion inside the casing 2. The scanner unit 8 is configured to emit laser beams to four photoconductive drums as indicated by dotted lines in FIG. 1A in accordance with image data so that the surfaces of the photoconductive drums 16 are exposed to the laser beams which are modulated based on the image data.

The process unit 9 is arrange below the scanner unit 8 and above the transfer unit 10. The process unit 9 has a process frame 14 and four developing cartridges 15. The process frame 14 supports the four photoconductive drums 16 and four charging rollers 17.

The four photoconductive drums 16 are arranged in parallel in the front-and-rear direction with a predetermined space therebetween. Each of the four photoconductive drums 16 has a cylindrical shape extending in the right-and-left direction (i.e., its axis extends in the right-and-left direction).

The charging rollers 17 are located at upper rear positions of corresponding photoconductive drums 16 and contact thereto, respectively. Each of the four charging rollers 17 has a cylindrical shape extending in the right-and-left direction (i.e., its axis extends in the right-and-left direction).

The four developing cartridges 15 are arranged on upper front positions with respect to the corresponding photoconductive drums 16, respectively. Thus, the four developing cartridges 15 are arranged in parallel in the front-and-rear direction. Each of the developing cartridges 15 has a box-like shape extending in the right-and-left direction. The developing cartridges 15 are detachably supported by the process frame 14.

Each of the developing cartridges 15 has a developing roller 20, a supplying roller 21 and a regulation blade 22. The developing roller 20 is rotatably supported at a lower end portion of each developing cartridge 15 such that the developing roller 20 is exposed toward rear side. The developing rollers 20 contact upper front portions of the photoconductive drums 16, respectively. The supply rollers 21 contact upper front portions of the developing rollers 20, respectively.

The regulation blades 22 contact the upper end portions of the developing rollers 20, respectively.

Each of the developing cartridges 15 is defined at an upper space above the regulation blade 22 and accommodates the toner.

The transferring unit 10 is arranged above the feeding unit 5 and below the process unit 9. The transferring unit 10 has a driving roller 24, a driven roller 25, a conveying belt 26 and four transfer rollers 27.

The driving roller 24 and the driven roller 25 are arranged to be spaced from each other in the front-and-rear direction, and to face each other.

The conveying belt 26 is wound around the driving roller 24 and the driven roller 25. Thus, the driving roller 24 and the driven roller 25 contact inner surface of the conveying belt 24. The upper part of the conveying belt 26 in the wound state contacts the lower parts of the four photoconductive drums 16.

The four transfer rollers 27 are provided for the four photoconductive drums 16, respectively. Specifically, the four transfer rollers 27 are arranged such that the upper part of the conveying belt 26 is sandwiched between the four transfer rollers 27 and the four photoconductive drums 16.

In the casing 2, a path sensor 26 is arranged below the driving roller 24.

The fixing unit 11 is arranged on the rear side of the transfer unit 10. The fixing unit 11 has a heat roller 30 and a pressure roller 31 that is arranged on a lower rear side of the heat roller 30 and urged toward the heat roller 30.

When an image forming operation is executed, the supply roller 21 rotates, the toner inside each developing cartridge 15 is friction-charged as being agitated between the supply roller 21 and the developing roller 20, and the charged toner is supplied to the developing roller 20.

The regulation blade 22 is configured to regulate, as the developing roller 20 rotates, the thickness of the toner supplied to the circumferential surface of each developing roller 20.

The circumferential surfaces of the photoconductive drums 16 are uniformly charged by the charging rollers 17 and exposed to the laser beams emitted by the scanner unit 8, respectively. By exposing the circumferential surfaces of the photoconductive drums 16, the scanner unit 8 forms electrostatic latent images on the surfaces of the photoconductive drums 16, respectively, based on the image data.

The developing rollers 20 supply the toner carrying on their circumferential surfaces onto the electrostatic latent images on the circumferential surfaces of the photoconductive drums 16, respectively. Then, the latent images are developed. That is, after the development, the photoconductive drums 16 carry developed images (i.e., toner images) on their circumferential surfaces, respectively.

A plurality of rollers of the feeding unit 5, by their rotation, convey the sheets P accommodated in the feed tray 7 toward a portion between the photoconductive drums 16 and the conveying belt 26 such that the sheet P makes a U-turn toward an upper rear direction, one by one at a predetermined timing.

The conveying belt 26 conveys the sheet P from the front side to the rear side so that the sheet P passes the nips between the photoconductive drums 16 and the transfer roller 27 sequentially. When the sheet P passes each nip, the toner image carried by the photoconductive drum 16 is transferred to the sheet P.

The fixing unit 11 applies the heat and pressure to the sheet P when the sheet P passes through the nip between the heat roller 30 and the pressure roller 31. When the sheet P passes through the nip between the heat roller 30 and the pressure roller 31, the image transferred on the sheet P is fixed onto the sheet P.

Thereafter, an ejection roller 33 conveys the sheet P such that the sheet P makes a U-turn toward the upper front direction to eject the sheet P on a sheet ejection tray 34 defined on an upper surface of the casing 2.

<Details of Process Unit>

The process unit 9 has, as described above, the process frame 14 and a process-side conveying tube 78.

Figure 5:
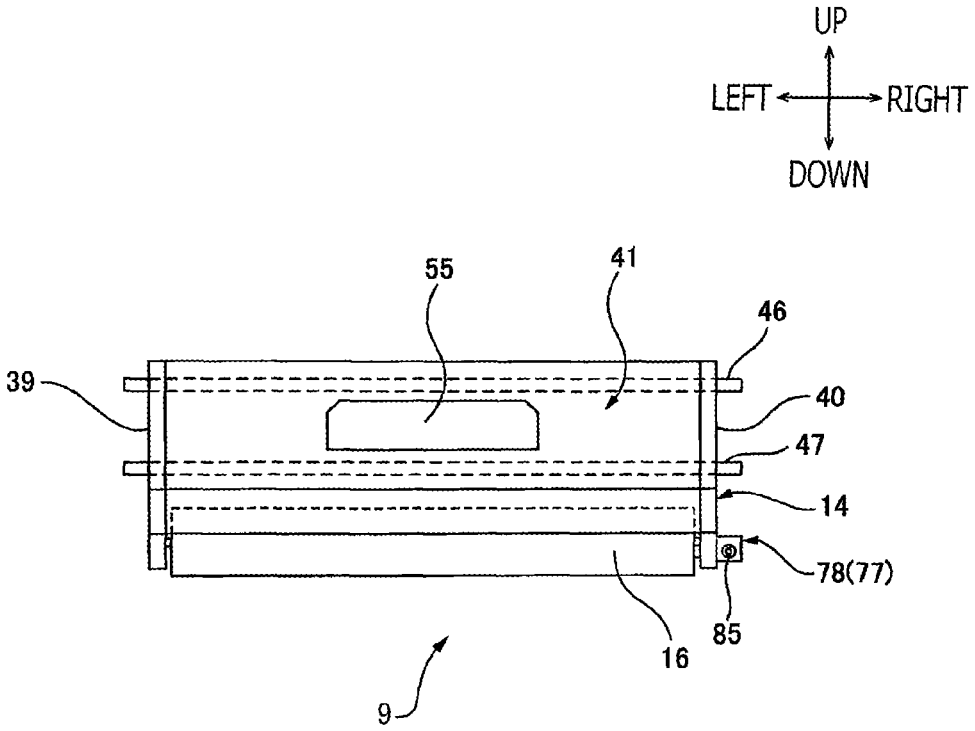
FIG. 5 is a front view of the process frame shown in FIG. 1A.

The process frame 14 has a frame-like shape when viewed from the above. The process frame 14 has a left wall 39, a right wall 40, a first positioning shaft 46, a second positioning shaft 47 and a front beam 41 (see FIG. 5).

The left wall 39 is arranged at a left end portion of the process frame 14, and has a substantially rectangular shape extending in the front-and-rear direction when viewed from the right-and-left direction.

The right wall 40 is arranged at a right end portion of the process frame 14 so as to be spaced rightward from the left wall 39, and has a substantially rectangular shape extending in the front-and-rear direction when viewed from the right-and-left direction.

The process frame 14 supports the four photoconductive drums 16, the four charging rollers 17 and four drum cleaning units 48 (see FIG. 1). The four photoconductive drums 16 and the four charging rollers 17 are supported between the right wall 40 and the left wall 39.

The four drum cleaning units 48 are configured to remove adhered matter such as residual toner adhered on the photoconductive drums 16, respectively. The four drum cleaning units 48 are also supported by the right wall 40 and the left wall 39. Each drum cleaning unit 40 has a drum cleaner frame 49, a drum cleaning blade 50 and a drum cleaner screw 51.

The drum cleaner frame 49 is arranged on the rear side of each photoconductive drum 16. The drum cleaner frame 49 has a shape of a polygonal column extending in the right-and-left direction, and bridged between the right wall 40 and the left wall 39. Each drum cleaner frame 49 has an opening 52.

The opening 52 is an opening extending in the right-and-left direction so as to cover an entire range, in the right-and-left direction, of the drum cleaner frame 49 and formed as a through opening penetrated on the front surface of the drum cleaner frame 49 at a central part in the up-and-down direction.

The drum cleaning blade 50 is arranged at an upper front position of each drum cleaner frame 49. The drum cleaning blade 50 has a certain thickness in the front-and-rear direction, and has a planar plate shape extending in the right-and-left direction. The upper end portion of the drum cleaning blade 50 is secured to an inner surface of a front wall of the drum cleaner frame 49 at an upper peripheral portion of the opening 52. The lower end portion of the drum cleaning blade 50 faces an upper half to the opening 52 of the drum cleaner frame 49. Further, the lower end portion of the drum cleaning blade 50 contact the rear end part of the photoconductive drum 16.

The drum cleaner screw 51 is arranged inside the drum cleaner frame 49 at a lower end portion thereof. The drum cleaner screw 51 is a right-screw like auger screw extending in the right-and-left direction. The right end portion of a rotation shaft of the drum cleaner screw 51 is rotatably supported by the left wall 39 of the process frame 14. The right end portion of the rotation shaft of the drum cleaner screw 51 penetrates through the right wall 40 of the process frame 14 and inserted in a drum cleaner connection unit 82, which will be described later.

The first positioning shaft 46 has a cylindrical shape extending in the right-and-left direction. The first positioning shaft 46 penetrates upper rear end portions of the right wall 40 and the left wall 39 in the right-and-left direction. The left end portion of the first positioning shaft 46 is arranged on the left side with respect to the left wall 39 (see FIG. 5), and the right end portion of the first positioning shaft 46 is arranged on the right side with respect to the right wall 40. That is, the length of the first positioning shaft 46 in the right-and-left direction is longer than a distance between the right wall 40 and the left wall 39.

The second positioning shaft 47 has a cylindrical shape extending in the right-and-left direction. The second positioning shaft 47 penetrates front end portions and central portions in the up-and-down direction of the right wall 40 and the left wall 39 in the right-and-left direction. The left end portion of the second positioning shaft 47 is arranged on the left side with respect to the left wall 39 (see FIG. 5), and the right end portion of the second positioning shaft 47 is arranged on the right side with respect to the right wall 40. That is, the length of the second positioning shaft 47 in the right-and-left direction is longer than the distance between the right wall 40 and the left wall 39, and substantially the same as the first positioning shaft 46.

The front beam 41 is bridged between the front end portions of the right wall 40 and the left wall. The front beam 41 has a planar plate shape extending in the right-and-left direction. The front beam 41 has a grip portion 55.

The grip portion 55 is gripped by the user when the user detaches/attaches the process frame 14 from/to the casing 2.

Figures 2A, 2B:
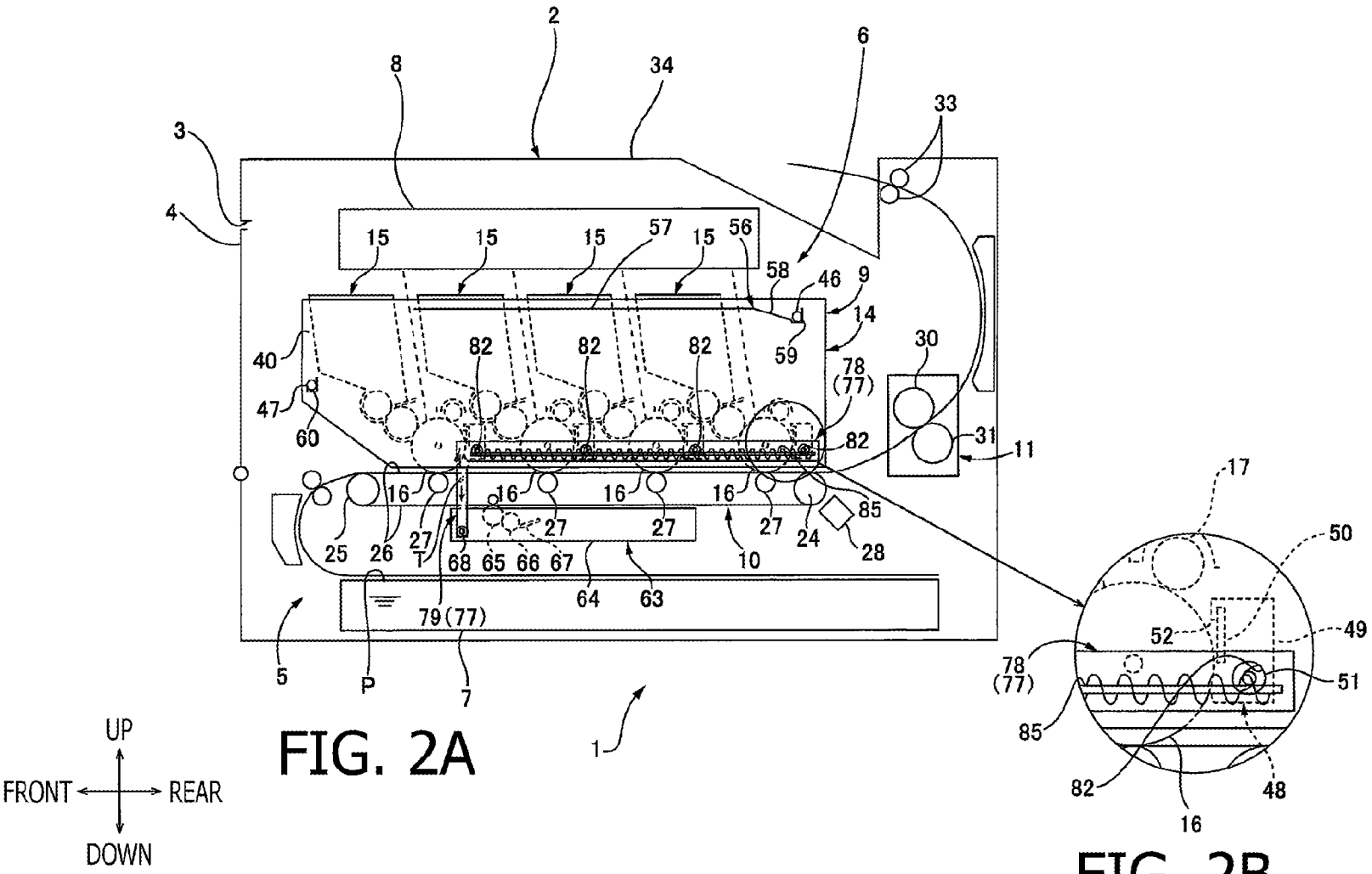
FIG. 2A is a cross sectional view showing movement of a process unit of the image forming apparatus shown in FIG. 1A with respect to a casing, and particularly showing a state where the process unit is located at an inside contact position.
FIG. 2B is a partially enlarged view of the image forming apparatus shown in FIG. 2A.
Figure 3:
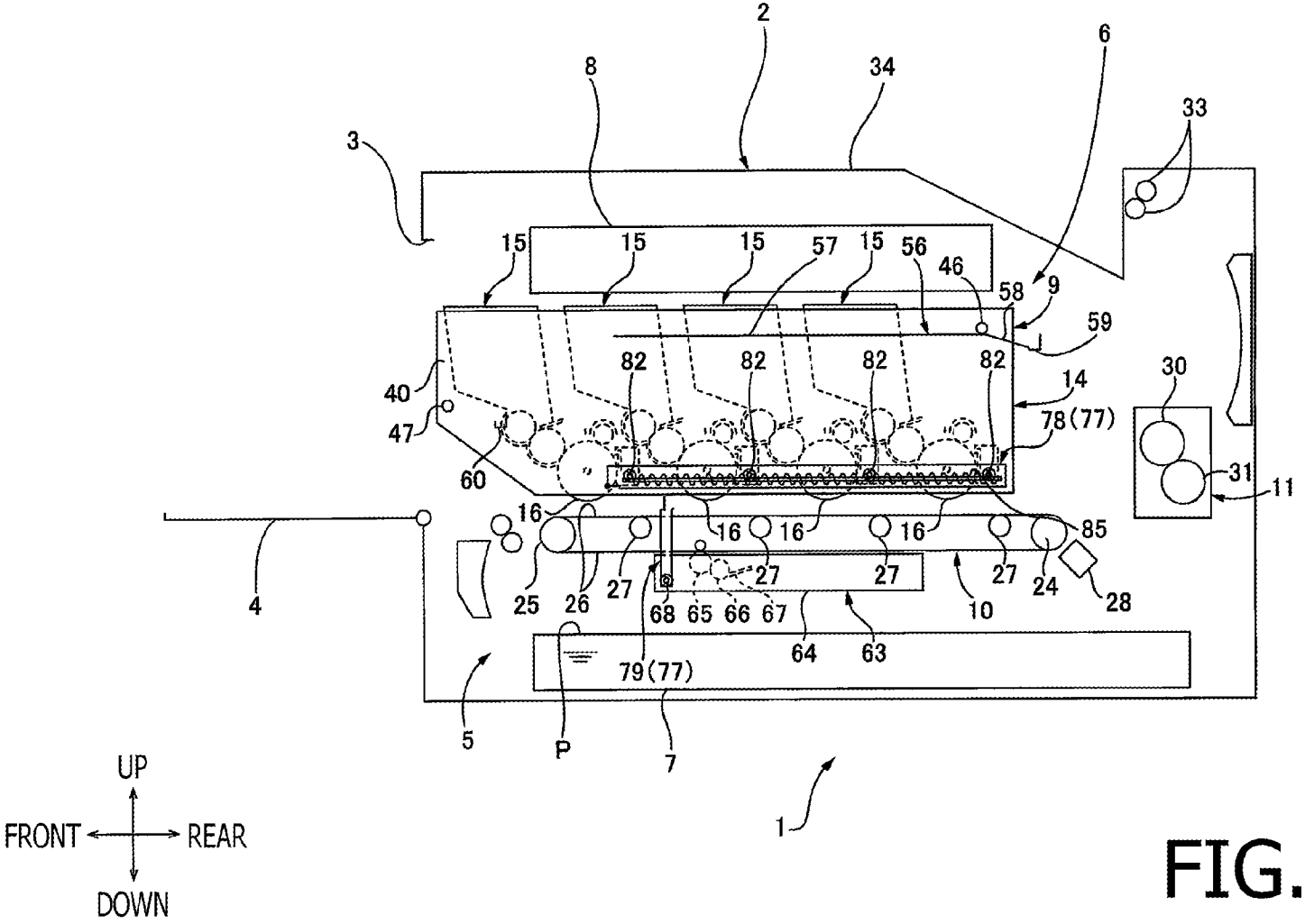
FIG. 3 is a cross sectional view showing movement of the process unit of the image forming apparatus shown in FIG. 1A with respect to the casing, and particularly showing a state where the process unit is located at an inside spaced position.
Figure 4:
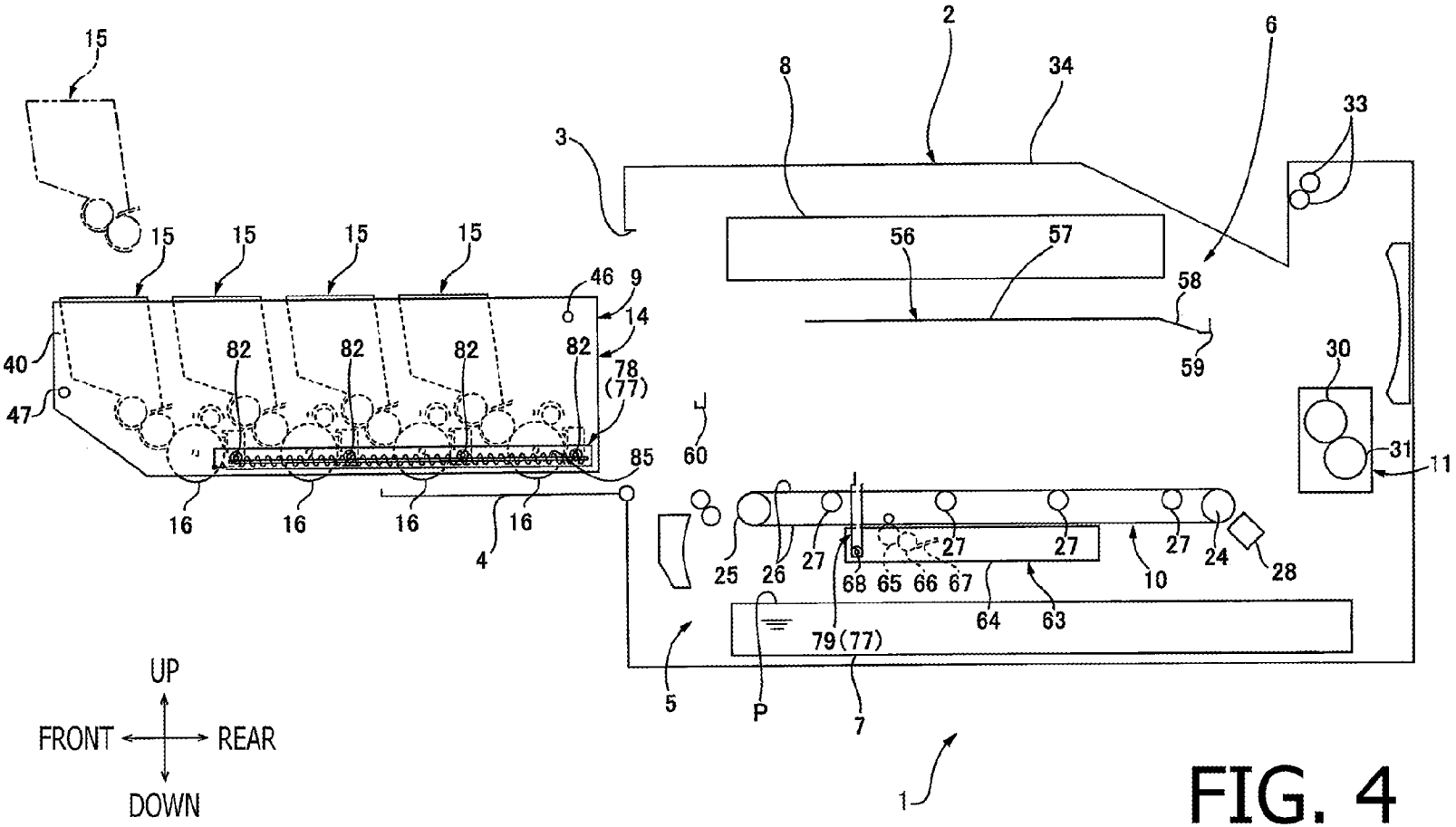
FIG. 4 is a cross sectional view showing movement of the process unit of the image forming apparatus shown in FIG. 1A with respect to the casing, and particularly showing a state where the process unit is located at an outside position.

The process unit 9 is configured to be movable between an inside position (see FIGS. 2A and 3) and an outside position (see FIG. 4). When the process unit 4 is located at the inner position as shown in FIGS. 2A and 3, all of the four photoconductive drums 16 face the conveying belt 26 from the above. When the process unit 9 is located at the outer position, at least one of the four photoconductive drums does not face the conveying belt 26. Thus, in other words, the processing unit 4 movable between the inner position where all the four photoconductive drums 16 face the conveying belt and the outer position where at least one of the four photoconductive drums 16 does not face the conveying belt 26.

Further, the process unit 9 is configured to be located at a contact position (see FIG. 2A) and a spaced position (see FIG. 3). When the process unit 9 is located at the contact position as shown in FIG. 2A, the four photoconductive drums 16 contact the conveying belt 26. When the process unit 9 is located at the spaced position (see FIG. 3), none of the four photoconductive drums 16 contacts the conveying belt 26 (i.e., all the photoconductive drums 16 are spaced from the conveying belt 26). Thus, when the process unit 9 is located in the inside position, the process unit 9 can move between the inside contact position (see FIG. 2A) where the four photoconductive drums 16 contact the conveying belt 26 and the inside spaced position (see FIG. 3) where the four photoconductive drums 16 are spaced from the conveying belt 26. Further, the process unit 9 is configured to slidably move in the front-and-rear direction between the inside spaced position (see FIG. 3) and the outside position (see FIG. 4) where the process unit 9 is drawn out of the casing 2.

The process-side conveying tube 78 has a shape of a polygonal column extending in the front-and-rear direction (see FIGS. 2B and 7). The process-side conveying tube 78 is supported on the right wall of the process-frame 14. Specifically, the process-side conveying tube 78 is located on the right side with respect to the right wall 40, and arranged such that the process-side conveying tube 78 overlaps with all the photoconductive drums 16 and all the drum cleaning units 48 when projected in the right-and-left direction. The process-side conveying tube 78 has four drum cleaner connection sections 82, a second communication section 83, a process-side pressing section 87, a second shutter 84 and a conveying unit screw 85.

Each of the four drum cleaner connection sections 82 is formed as a substantially circular through hole formed on a left wall of the process-side conveying tube 78 for receiving drum cleaner screw 51 of corresponding one of the drum cleaning units 48.

The second communication section 83 is formed as a substantially circular through hole formed at a front end portion of a lower wall of the process-side conveying tube 78 (see FIG. 7). The outside and the inside of the process-side conveying tube 78 communicates through the second communication section 83. The process-side pressing part 87 has a planar plate like rectangular shape extending downward from the rear end of the second communication section 83.

Figure 7A:
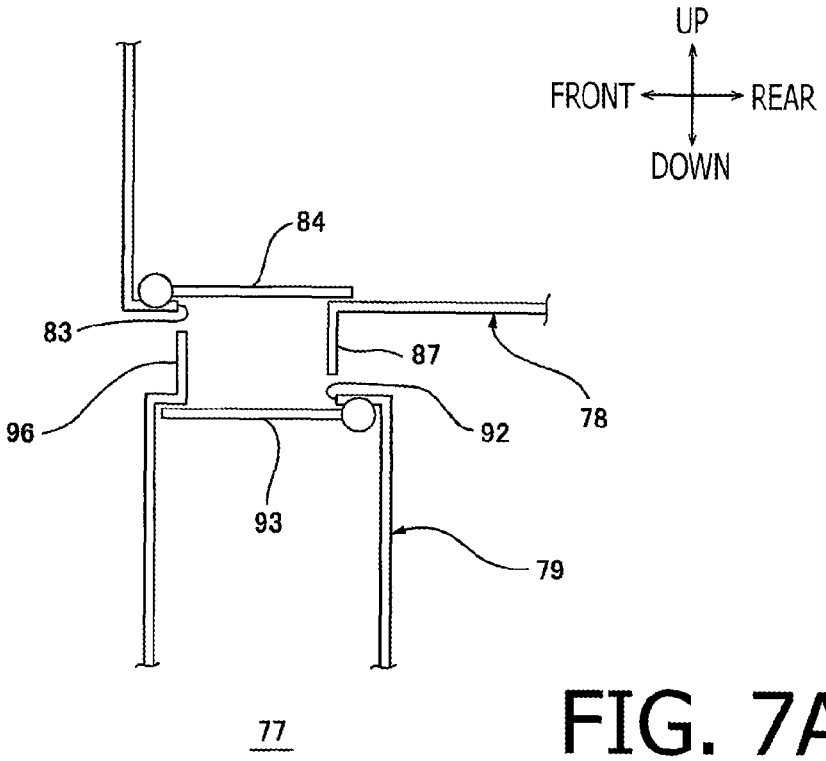
FIGS. 7A and 7B illustrate a connection between a process-side conveying tube and a casing-side conveying tube of the conveying mechanism. Specifically.
Figure 7B:
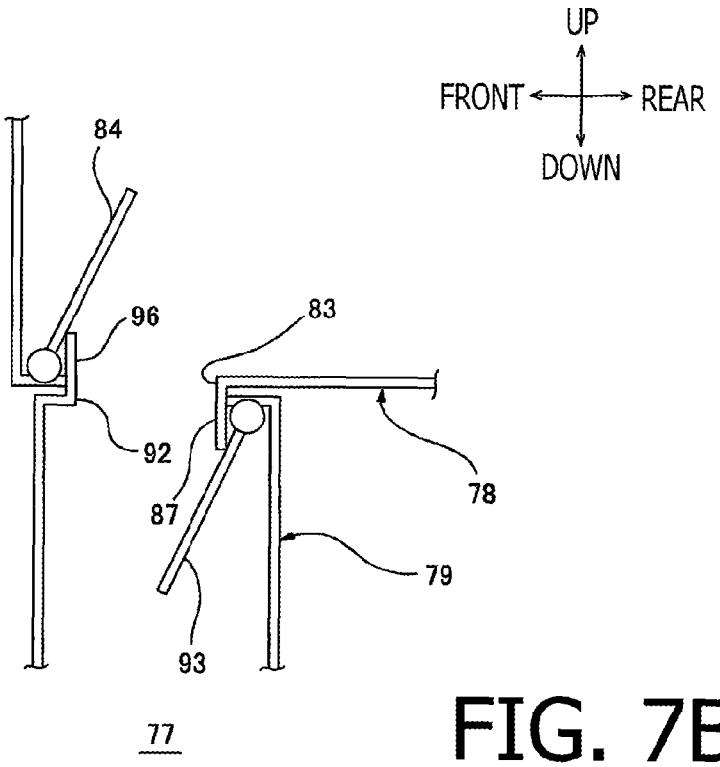
Figures 8A, 8B:
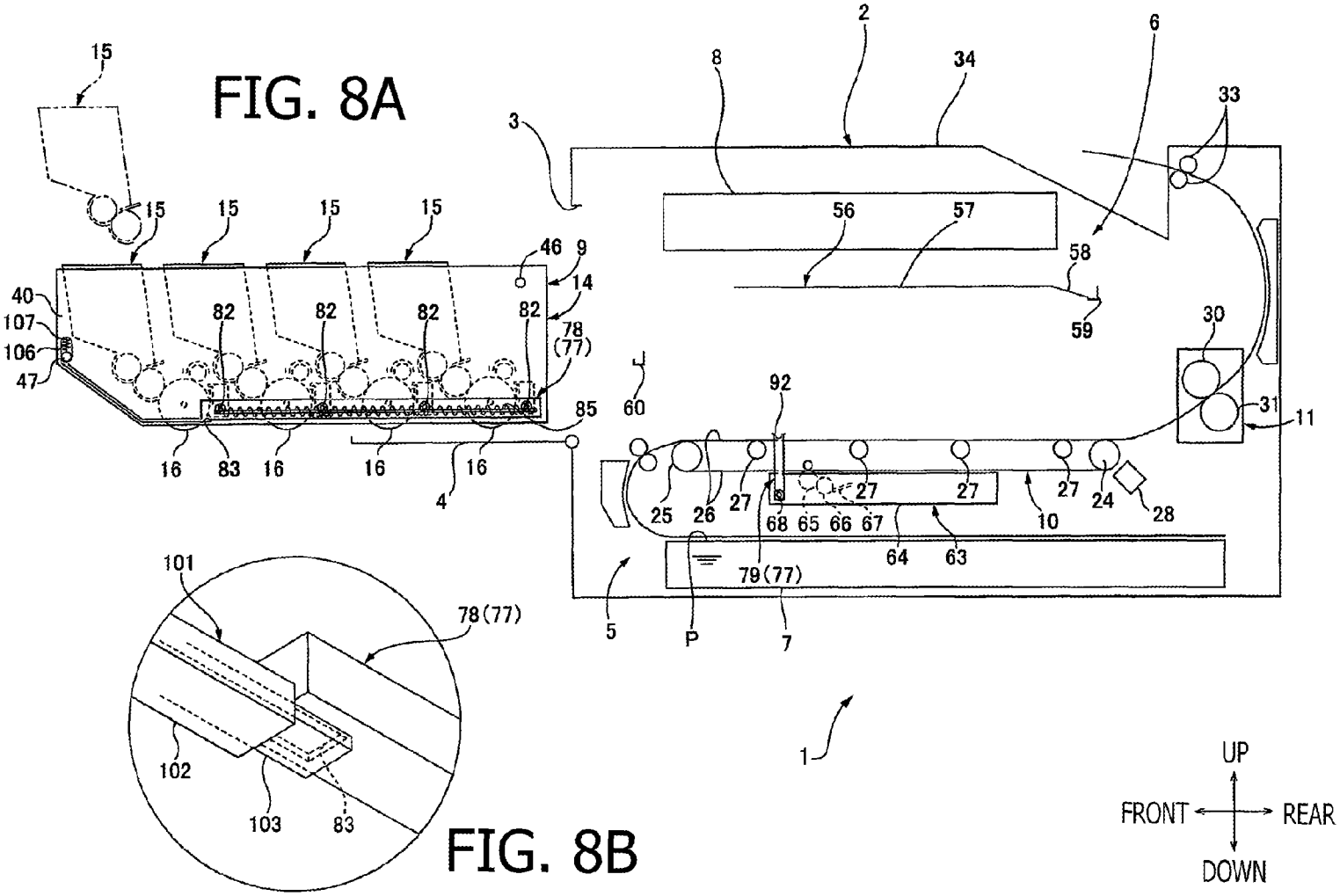
FIG. 8A is a cross sectional view showing movement of the process unit of the image forming apparatus with respect to the casing according to a second embodiment, and particularly showing a state where the process unit is located at an outside position.
FIG. 8B is a partial enlarged view of the process-side conveying tube shown in FIG. 8A.

The second shutter 84 is arranged above the second communication section 83. The second shutter 84 has a planar plate like shape extending in the front-and-rear and right-and-left directions. A length of the second shutter 84 in the front-and-rear direction is longer than a length of the second communication section 83 in the front-and-rear direction. The second shutter 84 is configured to rock (rotate) about a front end of the second shutter 84 between a close position (see FIG. 7A) and an open position (see FIG. 7B). When located at the close position (FIG. 7A), the second shutter 84 closes the second communication section 83 from the above. When located at the open position (FIG. 7B), the second shutter 84 opens the second communication section 83 such that a distal end of the second shutter 84 is directed toward upper rear direction as shown in FIG. 7B. According to the embodiment, the second shutter 84 is always urged to rotate in a clockwise direction when viewed from the right by an urging member to be neutrally located at the close position.

<Detailed Description of Casing>

The casing 2 has, as shown in FIG. 4, guide rails 56, a first positioning part 59, a second positioning part 60, and a casing-side conveying tube 79.

The guide rails 56 are configured to be protruded inwardly from inner surfaces of the right and left walls of the casing 2, respectively. Each of the guide rails 56 has a horizontal section 57 and an inclined section 58.

The horizontal section 57 has a linear shape extending in the front-and-rear direction below the scanner unit 8. The inclined section 58 is connected from the rear end of the horizontal section 57, and inclined downward from the front side to the rear side thereof.

Each of the first positioning sections 59 has a substantially U-like shape when viewed from right-and-left direction, which is connected from the rear end of the inclined section 58 and opened upward. The first positioning sections 59 are configured to receive both ends portions, in the right-and-left direction, of the first positioning shaft 46. The first positioning s 59 position the process unit 9, inside the casing 2, at the contact position (see FIG. 2A).

The second positioning sections 60 are protruded inward from the inner surfaces of the right and left walls of the casing 2, respectively. Each of the second positioning sections 60 has a substantially U-like shape opened upward when viewed from the right-and-left direction. The second positioning sections 60 are configured to receive both end portions, in the right-and-left direction, of the second positioning shaft 47 of the process unit 9. The second positioning sections 60 position the process unit 9, inside the casing 2, at the contact position (see FIG. 2A).

The casing-side conveying tube 79 is supported by the right wall of the casing 2 at the front portion thereof. In other words, the casing-side conveying tube 79 is supported by the right wall of the casing 2 on a downstream side in a moving direction of the process unit 9 from the inside position to the outside position. The casing-side conveying tube 79 extends in the up-and-down direction (see FIGS. 6 and 7), and the lower end thereof is bent leftward to form a polygonal column shape. The bent portion at the lower end of the casing-side conveying tube 79 will be referred to as the bent portion 91. The casing-side conveying tube 79 has a third communication section 92 a casing-side pressing part 96, a third shutter 93 and a fourth communication section 94.

The third communication section 92 is a rectangular hole penetrating through a central portion, in the front-and-rear and right-and-left directions, of an upper portion of the casing-side conveying tube 79. The third communication section 92 allows communication between the outside and the inside of the casing-side communication tube 79 through the third communication section 92.

The casing-side pressing part 96 has a planar plate like rectangular shape extending from the front end of the third communication section 92 upward. A length of the casing-side pressing part 96 is substantially the same as a length of the process-side pressing part 87 in the up-and-down direction.

The third shutter 93 is arranged below the third communication section 92. The third shutter 93 is a planar plate-like shape extending in the front-and-rear, and right-and-left directions. A length of the third shutter 93 in the front-and-rear and right-and-left directions are longer than those of the third communication section 92, respectively.

The third shutter 93 is configured to rock (rotate) about a rear end portion of the third shutter 93 and movable between a close position (see FIG. 7A) and an open position (see FIG. 7B). When located at the close position, the third shutter 93 closes the third communication section 92 from below as shown in FIG. 7A. When located at the open position, the third shutter 93 opens the third communication section 92 such that the distal end of the third shutter 93 is directed to lower front direction as shown in FIG. 7B. The third shutter 93 is urged by an urging member (not shown) clockwise when viewed from the right so as to be neutrally located at the close position to close the third communication section 92.

The fourth communication section 94 is a circular hole penetrating through the left part of the bent portion 91 of the casing-side conveying tube 79. Through the fourth communication section 94, the outside and inside of the casing-side conveying tube 79 communicate. It is noted that the process-side conveying tube 78 and the casing-side conveying tube 79 constitute the conveying mechanism 77.

<Transferring Unit>

The transferring unit 10 has a belt cleaning unit 63 (see FIG. 1A).

The belt cleaning unit 63 is configured to remove substances (e.g., toner) adhered on the conveying belt 26. The belt cleaning unit 63 is arranged below the conveying belt 26, and has a belt cleaner frame 64, a primary roller 65, a secondary roller 66, a scraping blade 67 and a belt cleaner screw 69.

Figure 6A:
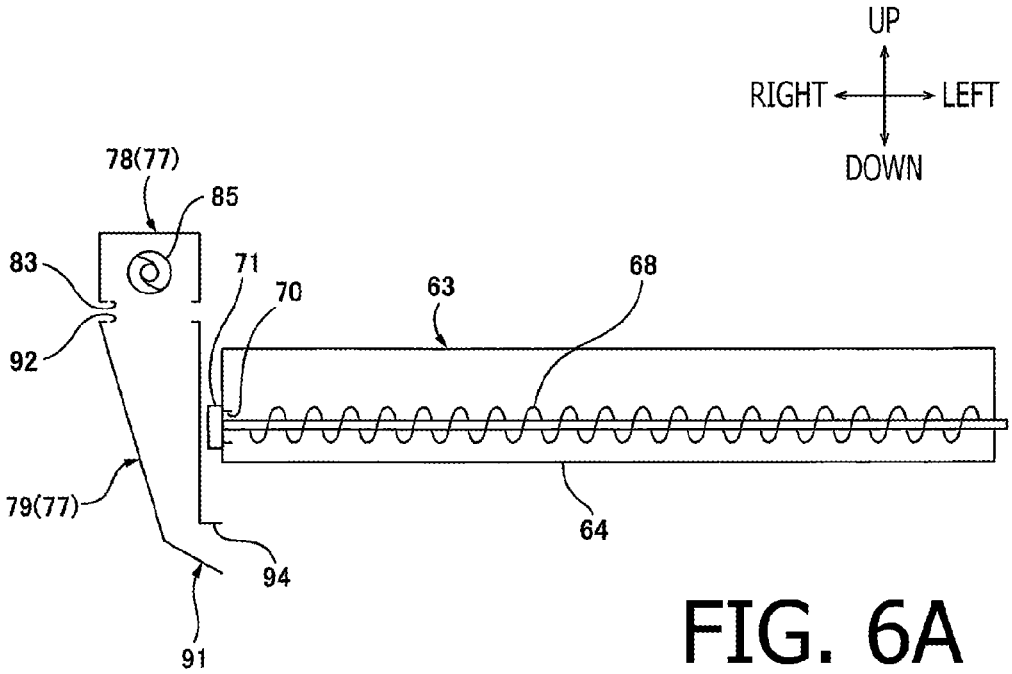
FIGS. 6A and 6B illustrate connection between a conveying mechanism and a belt cleaning unit.
Figure 6B:
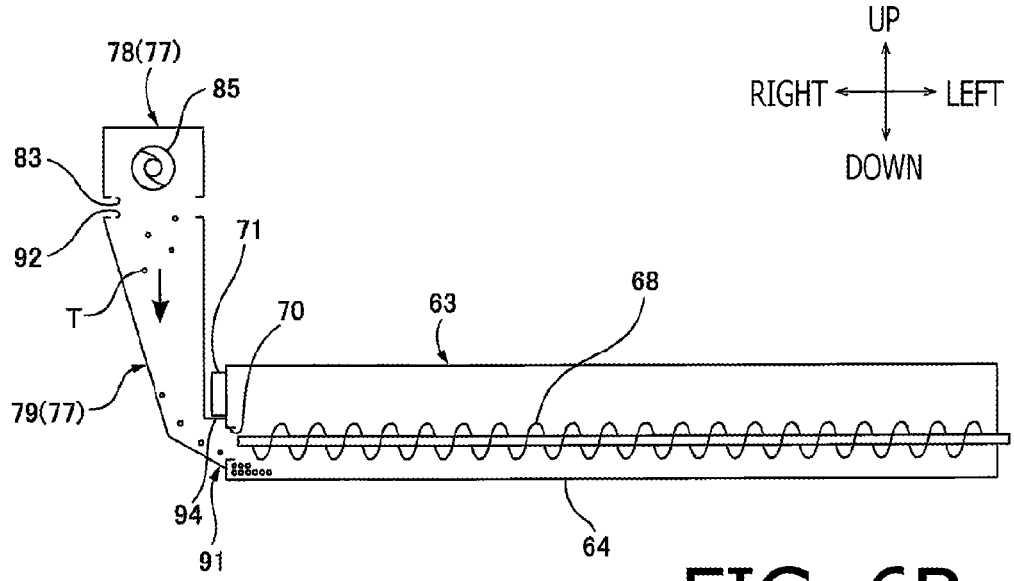

The belt cleaner frame 64 has a box-like shape when viewed in the right-and-left direction. The belt cleaner frame 64 has a first communication section 70 and a first shutter 71 as shown in FIGS. 6A and 6B.

The first communication section 70 is a circular hole penetrating through the right wall of the belt cleaner frame 64, at a lower front portion thereof.

The first shutter 71 is arranged on the right side with respect to the first communication section 70. The first shutter 71 has a planar plate-like rectangular shape. A length of the first shutter 71 in each of the front-and-rear and up-and-down directions is longer than a diameter of the first communication section 70. The first shutter 71 is configured to slide between a close position shown in FIG. 6A and an open position shown in FIG. 6B. When located at the close position, the first shutter 71 close the first communication section 70 from right as shown in FIG. 6A. When located at the open position, the first shutter 71 is located on an upper position than the first communication section 70 when projected in the right-and-left direction as shown in FIG. 6B, and opens the first communication section 70. The first shutter 71 is urged downward, by an urging member (not shown), so as to be neutrally located at the close position where the first shutter 71 close the first communication section 70.

The primary roller 65 is rotatably arranged at an upper end inside the belt cleaner frame 64 (see FIG. 1A). The primary roller 65 has a cylindrical shape extending in the right-and-left direction.

The secondary roller 66 is rotatably arranged inside the belt cleaner 64, at a lower rear position with respect to the primary roller 65 so as to contact the same. The secondary roller 66 has a cylindrical shape extending in the right-and-left direction.

The scraping blade 67 is arranged to contact the rear portion of the secondary roller 66. The scarping blade 67 has a certain thickness in the up-and-down direction, and has a planar plate-like shape extending in the right-and-left direction.

The belt cleaner screw 68 is a left-screw like auger screw extending in the right-and-left direction (see FIGS. 6A and 6B). The belt cleaner screw 68 is arranged inside the belt cleaner frame 64 such that it overlaps the first communication section 70 of the belt cleaner frame 64 when projected in the right-and-left direction. The left end portion of the belt cleaner screw 68 is rotatably supported on the left wall of the belt cleaner frame 64, while the right end portion of the belt cleaner screw 68 faces the first communication section 70 of the right wall of the belt cleaner frame 64.

The bent portion 91 of the casing-side conveying tube 79 contacts the lower surface of the first shutter 71 of the belt cleaner frame 64 of the belt cleaning unit 63 (see FIG. 6B). The bent portion 91 lifts up the first shutter 71, against an urging force applied by an urging member (not shown) so that the first shutter 71 is located at the open position.

As described above, the first communication section 70 and the fourth communication section 94 are arranged to communicate with each other, thereby connecting the belt cleaner frame 64 and the casing-side conveying tube 79.

Thus, when the process unit 9 is located at the inside contact position, the drum cleaner frame 49 of the drum cleaning unit 48 and the belt cleaner frame 64 of the belt cleaning unit 63 communicate with each other via the conveying mechanism 77. It is noted that a shutter for opening/closing the fourth communication section 94 may be provided in the casing-side conveying tube 79.

<Collecting Operation for Conveying Belt and Photoconductive Drums>

The printer 1 is configured to transfer the toner directly on the surface of the conveying belt 26 to form a printing pattern (patch) before executing the image forming operation.

As the conveying belt 26 is driven to go around, and when the printing pattern faces the patch sensor at a position below the transferring unit 10, the patch sensor 28 reads the printing pattern and measures shift among the color components and thickness (density) of the images.

Thereafter, as the conveying belt 26 further proceeds and when the printing pattern passes through a portion where the primary roller 65 contacts the conveying belt 26, the adhered substance such as residual toner adhered on the conveying belt 26 is caught by the primary roller 65 with the cleaning bias applied to the primary roller 65. Further, the adhered substance still residual on the conveying belt 26 is caught by the secondary roller 66 with the cleaning bias applied to the secondary roller 66. The adhered substance caught by the secondary roller 66 is scraped by the scraping blade 67 and collected inside the belt cleaner frame 64. As above, the substances adhered on the conveying belt 26 (e.g., residual toner) can be removed. With the above operation, measurement of shifts of the color components and thickness of the images is completed.

As described above, the sheet P is fed toward the image forming unit 6, then conveyed to pass through a portion between the photoconductive drums 16 and the transferring rollers by the conveying belt 26 from the rear to the front, and an image is formed on the sheet P.

After an image is formed on the sheet P and before the next image formation (a next image is formed), as shown in FIG. 2A, adhered substances such as the waste toner adhered on the four photoconductive drums 16 are removed. Hereinafter, the adhered substances such as the toner adhered on the four photoconductive drums 16 will be referred to by a term "waste toner T" for simplifying the description.

The drum cleaning blade 50 contacting the rear portion of the corresponding photoconductive drum 16 scrapes the residual toner T from the photoconductive drum 16 and collects the same in the drum cleaner frame 49.

Then, the drum cleaner screw 51 conveys the waste toner T collected inside the drum cleaner frame 49 to the right end portion of the drum cleaner frame 49 as it revolves, and further conveys the waste toner T to the process-side conveying tube 78 via the drum cleaner connection section 82. The conveying unit screw 85 inside the process-side conveying tube 78 revolves to convey the waste toner T conveyed to the process-side conveying tube 78 frontward.

The waste toner T conveyed frontward inside the process-side conveying tube 78 falls into the casing-side conveying tube 79 by its own weight via the second communication section 83 and the third communication section 92 (see FIG. 6B). The waste toner T conveyed into the casing-side conveying tube 79 enters the belt cleaner frame 64 vial the fourth communication section 94 and the first communication section 70.

The belt cleaner screw 68 revolves to convey the waste toner T entered in the belt cleaner frame 64 from right to left inside the belt cleaner frame 64 and agitate the same. As above, in the belt cleaner frame 64, the substances such as the residual toner removed from the conveying belt 26 and the four photoconductive drums 16 is collected.

<Exchange of Developing Cartridge and Cleaning Unit>

The process unit 9 is secured such that the first positioning shaft 46 is received by the first positioning section 59 and the second positioning shaft 47 is received by the second positioning section 60. With the above configuration, the process unit 9 is positioned at the inside contact position.

Further, when the process unit 9 is located at the inside contact position, the casing-side pressing section 96 contacts the lower surface of the second shutter 84 and urges the second shutter 84 upward. With this configuration, the second shutter 84 is located at the open position, against the urging force applied by an urging member (not shown) to the second shutter 84.

Further, the process-side pressing section 87 of the process-side conveying tube 78 contacts the upper surface of the third shutter 93 and urges the third shutter 93 downward. With this configuration, the third shutter 93 is located at the open position against the urging force applied by an urging member (not shown) to the third shutter 83.

As described above, the process-side conveying tube 78 and the casing-side conveying tube 79 are connected such that the second communication section 83 and the third communication section 93 communicate with each other.

When the developing cartridge 15 is exchanged, the process unit 9 is drawn from the inside position to the outside position as shown in FIGS. 2A and 4.

In order to draw the process unit 9 from the inside position to the outside position, firstly, the process unit 9 is to be moved from the inner contact position to the inner spaced position as shown in FIGS. 2A and 3. For this purpose, the front cover 4 for the casing 2 is rotated frontward about its lower end so as to locate the front cover 4 at the open position.

When a user grasps the grip 55 of the process frame 14 (see FIG. 5) and slightly lifts up the front portion of the process unit 9, the positioning of the second positioning shaft 47 with respect to the second positioning section 60 is released.

Thereafter, when the user moves the process unit 9 frontward, the positioning of the first positioning shaft 46 with respect to the first positioning section 59 is released. Further, the rear portion of the process unit 9 moved in an upper front direction as the first positioning shaft 46 is guided by the upper surface of the inclined section 58.

As a result, the process unit 9 moves upward relative to the casing 2 as shown in FIG. 3, and the four photoconductive drums 16 are moved to positions spaced from the conveying belt 26. When in this state, in the conveying mechanism 77, the process-side conveying tube 78 and the casing-side conveying tube 79 relatively move away from each other. Thus, as shown in FIG. 7A, the casing-side pressing section 96 is spaced from the second shutter, and the process-side pressing section 87 is spaced from the third shutter 93.

Then, as the urging force is applied by the urging member (not shown) to the second shutter 84, the second shutter 84 rotates clockwise, when viewed from the right, about the front end portion thereof such that the shutter 84 is moved from the open position to the close position. Similarly, the third shutter 93 rotates by the urging force applied by an urging member (not shown) clockwise, when viewed from the right, about the rear end portion thereof such that the third shutter 93 is located from the open position to the close position.

With the above operation, movement of the process unit 9 from the inside contact position to the inside spaced position has completed.

Next, the process unit 9 is moved from the inside spaced position to the outside position. In order to further move the process unit 9 from the inside spaced position to the outside position, the user may draw the process unit 9 frontward. Then, the process unit 9 slid frontward as the first positioning shaft 46 is guided by the upper surface of the horizontal part 57. As a result, the process unit 9 is drawn out of the casing 2 via the opening 3 and located at the outside position (see FIG. 4). As described above, the process unit located at the inside spaced position to the outside position has completed.

Next, the developing cartridges 15 may be detached from the process unit 9. In order to detach the developing cartridges 15 from the process unit 9, the user may pull the developing cartridges 15 upward. Then, the developing cartridges 15 are detached from the process unit 9. Thus, the developing cartridges 15 can be exchanged.

In order to position the process unit 9 located at the outside position to the inside contact position, the user may handle the process unit 9 opposite to the above for drawing the process unit 9.

In order to locate the process unit 9 at the outside position to the inside position, the user may open the opening 3, and place the first positioning shaft 46 on the upper surface of the horizontal part 57. Then, the user may grasp the grip 55 and slides the process unit 9 rearward. Then, the first positioning shaft 46 is moved to the rear end portion of the horizontal part 57, and the process unit 9 is moved from the outside position to the inside spaced position. When the user further push the process unit 9 rearward, the first positioning shaft 46 is guided by the inclined part 58 and the rear portion of the process unit 9 moved in the lower rear direction.

Finally, the first positioning shaft 46 is received by the first positioning section 59 (i.e., the positioning of the first positioning shaft 46 is completed). Thereafter, when the user slightly moves the front portion of the process unit 9 downward, the second positioning shaft 47 is received by the second positioning section 69 and the positioning thereof is completed.

As above, the process unit 9 has been moved from the inside spaced position to the inside contact position, and the four photoconductive drums 16 contact the conveying belt 26 (see FIG. 2A). In this state, since the process-side conveying tube 78 and the casing-side conveying tube 79 approach relative to each other in the up-and-down direction, the casing-side pressing section 96 contacts the second shutter 84 and the process-side pressing section 87 contacts the third shutter 93 (see FIG. 7B).

As a result, the second shutter 84 rotates counterclockwise, when viewed from the right side, about the front end portion of the second shutter 84 against the urging force applied to the second shutter 84 by the urging member (not shown), and the second shutter 84 is moved from the close position to the open position. Similarly, the third shutter 93 rotates counterclockwise, when viewed from the right side, about the rear end portion of the third shutter 93 against the urging force applied by the urging member (not shown), and the third shutter 93 is moved from the close position to the open position. Thus, the process-side conveying tube 78 and the casing-side conveying tube 79 have been connected.

After the positioning of the process unit 9 is completed, the user may close the front cover 4 (i.e., rotates the front cover 4 rearward about the lower end portion thereof). As above, the exchanging operation of the developing cartridges 15 has been completed.

In order to exchange the belt cleaning unit 63, firstly the user draw the process unit 9 out of the casing 2 as described above. Thereafter, the user may detach the transferring unit 10 from the casing 2. Specifically, in order to detach the transferring unit 10 from the casing, the user may integrally take the driving roller 24, the driven roller 25, the conveying belt 26 and the transferring rollers 27 out of the casing 2, through the opening 3.

Next, the user may lift the belt cleaning unit 63 upward as shown in FIG. 6A. Then, the first communication section 70 of the belt cleaning unit 63 is displaced from the fourth communication section 94 of the casing-side conveying tube 79 in the up-and-down direction.

The first shutter 71 is urged by the urging member (not shown) such that the first shutter 71 neutrally located at the close position at which the first shutter close the first communication section 70. Therefore, as the first communication section 70 and the fourth communication section 94 displace from each other, the belt cleaning unit 63 and the casing-side conveying tube 79 is disconnected with the first communication section 70 being closed.

Thereafter, the user take the belt cleaning unit 63 out of the casing 2 via the opening 3. When the belt cleaning unit 63 is to be attached, the user may locate the belt cleaning unit 63 inside the casing 2, and moves the same downward. Then, as shown in FIG. 6B, the first shutter 71 contacts the bent portion 91 of the casing-side conveying tube 79 from the above, and lifted relatively upward, against the urging force applied by the urging member (not shown), relative to the belt cleaner frame 64, and located to the open position. In this state, the belt cleaner frame 64 and the casing-side conveying tube 79 are connected with the first communication section 70 and the fourth communication section 94 being communicated with each other.

Next, the driving roller 24, the driven roller 25, the conveying belt 26 and the transferring rollers 27 are integrally attached inside the casing 2 through the opening 3. After the above, the process unit 9 is moved from the outside position to the inside contact position as is done when the developing cartridges 15 are exchanged. As above, the exchange operation of the belt cleaning unit 63 has been performed.

According to the above-described embodiment, the process frame 14 has the drum cleaning units 48. The waste toner T removed by the drum cleaning units 48 from the photoconductive drums 16 is conveyed in the process-side conveying tube 78 which is supported on the right wall 40 of the process frame 14.

Therefore, by moving the process unit 9, which has the process-side conveying tube 78, between the inside position and the outside position, it is ensured that connection/disconnection between the process-side conveying tube 78, which is connected to the four drum cleaning units 48, and the belt cleaner frame 64 with respect to the drum cleaning unit 48 can be done relatively simply.

Therefore, with a relatively simple structure, it is ensured that the waste toner T adhered on the photoconductive drums 16 is conveyed to the belt cleaner frame 64 with suppressing leakage of the waste toner T.

According to the printer 1, the process unit 9 has four photoconductive drums 16, and four drum cleaning units 48 respectively corresponding to the four photoconductive drums 16. The waste toner T removed from the four photoconductive drums 16 by the four drum cleaning units 48 is collected in the process-side conveying tube 78 which is supported on the right wall 40 of the process frame 14. Then, the waste toner T collected in the process-side conveying tube 78 is conveyed, as the conveying unit screw 85 revolves, to the front portion of the process-side conveying tube 78.

With this configuration, the waste toner removed from the four photoconductive drums 16 is collected in the process-side conveying tube 78, and then transferred to the belt cleaner frame 64 via the single casing-side conveying tube 79. Thus, with the relatively simple structure, the waste toner removed from the four photoconductive drums 16 can be collected and conveyed toward the belt cleaner frame 64.

Further, in association with the movement of the process unit 9 between the inside position and the outside position, the process-side conveying tube 78 which is connected to the four drum cleaning units 48 and the belt cleaner frame 64 can be connected/disconnected via the single casing-side conveying tube 78. With this configuration, in comparison with a structure having a plurality of connecting parts, it is ensured that connection/disconnection can be performed without fail.

Further, according to the printer 1, as shown in FIGS. 2A, 2B and 3, the process-side conveying tube 78 and the casing-side conveying tube 79 are connected/disconnected in association with the movement of the process unit 9 between the inside contact position and inside spaced position. With this configuration, simply by moving the process unit 9 by a relatively small amount, the process-side conveying tube 78 and the casing-side conveying tube 79 can be connected/disconnected, and it is not necessary to move the process unit 9 from the inside position to the outside position.

According to this printer 1, as shown in FIG. 2A, the process-side conveying tube 78 overlaps the four photoconductive drums 16 when projected in the right-and-left direction. With this structure, upsizing of the process unit 9 in the up-and-down direction can be suppressed.

Further, according to the printer 1, as shown in FIG. 4, the casing-side conveying tube 79 is arranged in the front side of the casing 2 (i.e., on the downstream side along a direction where the process unit 9 is moved when detached from the casing 2). Therefore, when the process unit 9 is completely detached from the casing 2, the user can easily access the casing-side conveying tube 79 through the opening 3. As a result, a maintenance operation for the casing-side conveying tube 79 can be performed easily.

According to the printer 1, as shown in FIGS. 6A and 6B, it is possible to attach/detach the belt cleaner frame 64 to/from the casing 2 with fixing the casing-side conveying tube 79 to the casing 2.

Second Embodiment

Hereinafter, referring to FIGS. 8A, 8B, 9A and 9B, the printer 1 according to the second embodiment will be described. In the following description, members similar to those in the first embodiment are assigned with the same reference numbers, and description thereof will be omitted for brevity.

In the first embodiment, as shown in FIGS. 7A and 7B, the second shutter 84 and the third shutter 93, each of which is configured to rotate about an axis defined on one side end thereof, move between the open positions and close positions to open/close the second communication section 83 and the third communication section 92, respectively, so that the process-side conveying tube 78 and the casing-side conveying tube 79 are connected/disconnected.

In contrast, according to the second embodiment, as shown in FIGS. 8A, 8B, 9A and 9B, the process-side conveying tube 78 has a shutter unit 101.

The shutter unit 101 has a hollow tube 102 and a belt shutter 103. The hollow tube 102 has a substantially rectangular cross section and extends from the front end part of the second communication section 83 to a portion below the second positioning shaft 47, along a lower front end of the right wall 40.

The belt shutter 103 is made of flexible material such as polypropylene or nylon. The belt shutter 103 has a rectangular column shape, and arranged inside the hollow tube 102 along the entire length thereof. The belt shutter 103 is configured to be movable within the hollow tube 102 along its inner surface between a close position (see FIG. 8A, 8B) and a close position (see FIGS. 9A and 9B). When located at the close position, the belt shutter 103 is positioned such that the rear end part of the belt shutter 103 is located on the rear side with respect to the rear end portion of the hollow tube 102. When located at the close position, the belt shutter 103 closes the second communication section 83 from below (see FIG. 8A). When located at the open position, the belt shutter 103 is located such that the rear end part thereof is located within the hollow tube 102 and opens the second communication section 83 (see FIG. 9A).

The front end part of the belt shutter 103 is connected to the right end part of the second positioning shaft 47. Further, by an urging force of an compression spring 107, the belt shutter 103 is urged to be neutrally located at the close position.

Each of the right wall 40 and the left wall 39 has a supporting elongated hole 106 and the compression spring 107. The supporting elongated hole 106 are formed to penetrate the front end portions of the right wall 40 and the left wall 39, at position substantially central portion in the up-and-down direction. The elongated holes 106 are formed to be elongated in the up-and-down direction. The compression spring 107 has a spiral shape and extends in the up-and-down direction. The compression sprint 107 is arranged in each supporting elongated hole 106.

The second positioning shaft 47 is inserted through the supporting elongated hole 106. The compression spring 107 is arranged such that an upper end thereof contacts an upper surface of the supporting elongated hole 106, and a lower end thereof contacts an upper end portion of the second positioning shaft 47. With this structure, the second positioning shaft 47 is constantly urged downward.

The casing-side conveying tube 79 does not have a shutter and the third communication section 92 is always open.

Figure 9B:
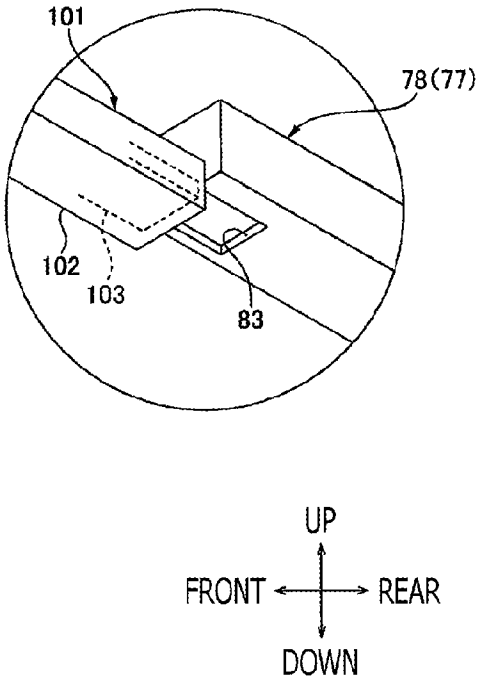
FIG. 9B is a partial enlarged view of the process-side conveying tube shown in FIG. 9A.
Figure 9A:
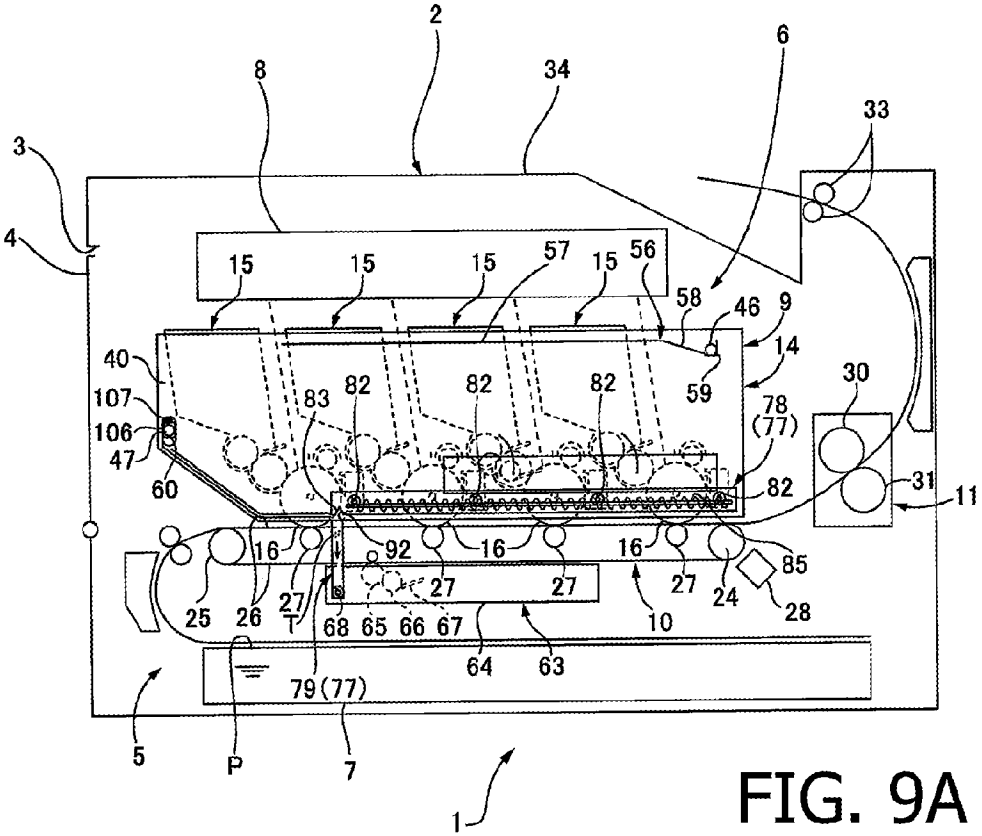
FIG. 9A is a cross sectional view showing movement of the process unit of the image forming apparatus with respect to the casing according to the second embodiment, and particularly showing a state where the process unit is located at an inside contact position.

The process unit 9 according to the second embodiment is configured such that the first positioning shaft 46 is received by the first positioning section 59, and the second positioning shaft 47 is received by the second positioning section 60 as shown in FIGS. 9A and 9B. With this configuration, the process unit 9 is positioned to the inside contact position.

When the process unit 9 is located at the inside contact position, the second positioning shaft 47 is located above the supporting elongated hole 106, due to the own weight of the process unit 9 and against the urging force of the compression spring 107 (see FIG. 9A). At this stage, the front end part of the belt shutter 103 which is connected to the second positioning shaft 47 follows the second positioning shaft 47 and located at a relatively front position. Accordingly, the rear end part of the belt shutter 103 is located at the open position so as to open the second communication section 83.

As described above, the process-side conveying tube 78 and the casing-side conveying tube 79 are connected such that the second communication section 83 and the third communication section 92 communicate with each other.

In order to exchange the developing cartridges 15, as in the first embodiment, the process unit 9 is drawn from the inside position to the outside position.

During the above drawing operation, the user may grasp the grip 55 and slightly lift the front portion of the process unit 9. Then, the positioning of the second positioning shaft 47 with respect to the second positioning section 60 is released, the second positioning shaft 47 is urged downward the compression spring 107 within the supporting elongated hole 106.

Then, the belt shutter 103 connected to the second positioning shaft 47 follows the movement of the second positioning shaft 47 and moves relatively rearward along the inner surface of the hollow tube 102. Thus, the rear end of the belt shutter 103 is located at the close position to close the second communication section 83.

Thereafter, by operating the process unit 9 in the same way as in the first embodiment, the movement of the process unit 9 from the inside position to the outside position will be completed and the user can exchange the developing cartridges 15.

In order to return the process unit 9 from the outside position to the inside position, the same operation as taken in the first embodiment is to be taken. During the above operation, when the second positioning shaft 47 is received by the second positioning section 60, the second positioning shaft 47 moves upward within the supporting elongated hole 106 due to the own weight of the process unit 9, against the urging force applied by the compression spring 107. Thus, the front end part of the belt shutter 103 follows the movement of the second positioning shaft so that the rear end part of the belt shutter 103 is located inside the hollow tube 102. Thereafter, by the similar operation as in the first embodiment, the developing cartridges 15 can be exchanged.

Exchanging of belt cleaning unit 63 can also be exchanged as in the first embodiment, and the description thereof will be omitted for brevity.

According to the second embodiment, effects similar to those obtained in the first embodiment can be obtained.

Third Embodiment

Hereinafter, referring to FIG. 10, the printer 1 according to the third embodiment will be described. The members similar to those referred to in the first embodiment will be assigned with the same reference numbers, and description thereof will be omitted for brevity.

In the first embodiment, each of the second shutter 84 and the third shutter 93 moves between the open position and the close position to connect/disconnect the second communication section 83 and the third communication section 92, thereby connecting/disconnecting the process-side conveying tube 78 and the casing-side conveying tube 79 (see FIGS. 7A and 7B).

According to the third embodiment, the process-side conveying tube 78 has a first rectangular column portion 111, a first contacting portion 112, a first guide groove 113, a first slide shutter 114, and a first tension spring 115. The casing-side conveying tube 79 has a second rectangular column portion 121, a second contacting portion 122, a second guide groove 123, a second slide shutter 124 and a second tension spring 125.

The first rectangular column portion 111 has substantially a rectangular column shape extending downward from a peripheral portion of the second communication section 83.

The first contacting portion 112 is spaced from and arranged on the rear side of the first rectangular column portion 111. The first contacting portion 112 is a planar plate having a rectangular shape when viewed from the front and extends downward from the lower wall of the process-side conveying tube 78.

The first guide groove 113 is arranged to be spaced frontward from the first rectangular column portion 111. The first guide groove 113 is a substantially rectangular through opening penetrating the lower wall of the process-side conveying tube 78. The length of the first guide groove 113 in the front-and-rear direction is longer than the length of the second communication section 83 in the front-and-rear direction, and the length of the first guide groove 113 in the right-and-left direction is shorter than the length of the second communication section 83 in the right-and-left direction.

The first slide shutter 114 has a first horizontal part 117 and a first vertical part 118. The first horizontal part 117 is arranged above the lower wall of the process-side conveying tube 78. The first horizontal part 117 has a planar plate-like shape extending in the front-and-rear, and the right-and-left directions. Lengths of the first horizontal part 117 in the front-and-rear and right-and-left directions are longer than lengths of the second communication section 83 in the front-and-rear and right-and-left directions, respectively.

The first vertical part 118 has a planar plate-like shape extending downward from the front end portion of the first horizontal part 117. A length of the first vertical part 118 in the right-and-left direction is shorter than the length of the first guide groove 113 in the right-and-left direction. A length of the first vertical part 118 in the up-and-down direction is longer than a length of the first rectangular column portion 111. The first vertical part 118 is inserted through the first guide groove 113, and a lower end portion of the first vertical part 118 is located on the lower side with respect to the lower end part of the first rectangular column portion 111. Thus, the first slide shutter 114 is a plate-like member and has an L-like shape when viewed from the right-and-left direction.

The first slide shutter 114 is configured to slide along the first guide groove 113 between a close position (see FIGS. 10A and 10B) and an open position (see FIG. 10C). When the first slide shutter 114 is located at the close position, the first vertical part 118 is located at the rear end portion of the first guide groove 113, and thus, the first horizontal part 117 close the second communication section 83 from the above (see FIGS. 10A and 10B). When the first slide shutter 114 is located at the open position, the first vertical part 118 is located at the front end position of the first guide groove 113, and thus, the first horizontal part 117 is located on the front side with respect to the second communication section 83 and open the same.

It is noted that the first slide shutter 114 is configured such that the first vertical part 118 is pulled rearward by the urging force of a first tension spring 115. By the urging force, the first slide shutter 114 neutrally located at the close position.

The first tension spring 115 is a spiral-shaped tension sprig extendable in the front-and-rear direction. The first tension spring 115 is configured such that the front end thereof is engaged with the first vertical part 118 of the first slide shutter 114, and the rear end thereof is engaged with the front wall of the first rectangular column part 111.

The second rectangular column part 121 has a substantially rectangular-column shape extending upward from the periphery of the third communication section 92.

The second contact part 122 is arranged on the front side with respect to the second rectangular column portion 121 with a certain space therebetween. The second contact part 122 has a planar plate-like member having a rectangular shape when viewed from the front and extending upward from the upper wall of the casing-side conveying tube 79.

The second guide groove 123 is arranged on the rear side with respect to the second rectangular column portion 121 with a certain space therebetween. The second guide groove 123 is a through hole having a substantially rectangular shape and formed on the upper wall of the casing-side conveying tube 79.

The second slide shutter 124 has a second horizontal part 127 and a second vertical part 128. The second horizontal part 127 is arranged below the upper wall of the casing-side conveying tube 79. The second horizontal part 127 has a planar plate-like shape extending in the front-and-rear and right-and-left directions. Lengths or the second horizontal part 127 in the front-and-rear and the right-and-left directions are longer than those of the third communication section 92.

The second vertical part 128 has a planar plate-like shape extending upward from the rear end portion of the second horizontal part 127. A length of the second vertical part 128 in the right-and-left direction is shorter than the length of the second guide groove 123 in the right-and-left direction. A length of the second vertical part 128 in the up-and-down direction is longer than a length of the second rectangular column portion 121. The second vertical part 128 is inserted through the second guide groove 123, and an upper end portion of the second vertical part 128 is located on the upper side with respect to the upper end part of the second rectangular column portion 121. Thus, the second slide shutter 124 is a plate-like member and has an L-like shape when viewed from the right-and-left direction.

The second slide shutter 124 is configured to slide along the second guide groove 123 between a close position (see FIGS. 10A and 10B) and an open position (see FIG. 10C). When the second slide shutter 124 is located at the close position, the second vertical part 128 is located at the front end portion of the second guide groove 123, and thus, the second horizontal part 127 close the third communication section 89 from the below (see FIGS. 10A and 10B). When the second slide shutter 124 is located at the open position, the second vertical part 128 is located at the rear end position of the second guide groove 123, and thus, the second horizontal part 127 is located on the rear side with respect to the third communication section 89 and open the same.

It is noted that the second slide shutter 124 is configured such that the second vertical part 128 is pulled forward by the urging force of a second tension spring 125. By the urging force, the second slide shutter 124 neutrally located at the close position.

The second tension spring 125 is a spiral-shaped tension sprig extendable in the front-and-rear direction. The second tension spring 125 is configured such that the rear end thereof is engaged with the second vertical part 128 of the second slide shutter 124, and the front end thereof is engaged with the rear wall of the second rectangular column part 121.

According to the third embodiment, there is no distinction between the inside contact position and inside spaced position, and the process unit 9 is configured to slidable between the inside position and the outside position.

When the process unit 9 is located at the inside position, since the second contact part 122 contacts the rear end portion of the first vertical part 118 (see FIG. 10C). Thus, the first slide shutter 114 is located on the front side against the urging force applied by the first tension spring 115, and located at the open position where the second communication section 83 is opened. Further, since the first contact part 112 contacts the front end part of the second vertical part 128, the second slide shutter 124 is located on the rear side, against the urging force applied by the second tension spring 125, and located at the open position at which the third communication section 92 is opened.

As above, the process-side conveying tube 78 and the casing-side conveying tube 79 are connected such that the second communication section 83 and the third communication section 92 communicate with each other.

In order to exchange the developing cartridge 15, the user may draw the process unit 9 from the inside position to the outside position as in the first embodiment. As the process unit 9 moves frontward from the inside position, the contact between the first vertical part 118 and the second contact part 122 is released, and the first slide shutter 114 moves rearward due to the urging force of the first tension spring 115. Then, the first slide shutter 114 is moved to the close position to close the second communication section 83. Further, the contact between the second vertical part 128 and the first contact part 112 is released, the second slide shutter 124 is moved forward due to the urging force of the second tension spring 125. Thus, the second slide shutter 124 is located to the close position to close the third communication section 92. Thereafter, by the similar operation as in the first embodiment, the movement of the process unit 9 from the inside position to the outside position is completed and the developing cartridges 15 can be exchanged.

In order to return the process unit 9 from the outside position to the inside position, the same operation as taken in the first embodiment is to be taken. During the movement of the process unit 9, as the first vertical part 118 is brought into contact the second contacting part 112 from the front side, the first slide shutter 114 moved frontward against the urging force of the first tension spring 115, and is located to the open position to open the second communication section 83. Further, as the second vertical part 128 is brought into contact the first contact part 112 from the rear side, the second slide shutter 124 moves rearward against the urging force of the second tension spring 128, and is located at the open position to open the third communication section 92. Thereafter, by the similar operation as in the first embodiment, the developing cartridges 15 can be exchanged.

Exchanging of belt cleaning unit 63 can also be exchanged as in the first embodiment, and the description thereof will be omitted for brevity. According to the third embodiment, the process-side conveying tube 78 and the casing-side conveying tube 79 are connected/disconnected by the sliding movement of the process unit 9 (see FIGS. 10A-10C). Thus, simply by sliding the process unit 9, the process-side conveying tube 78 and the casing-side conveying tube 79 can be connected/disconnected. Further, according to the third embodiment, effects similar to those obtained in the first embodiment can be obtained.

Fourth Embodiment

Similar to the other embodiments, in the description on the fourth embodiment, members similar to those used in the first embodiment are assigned with the same reference numbers and description thereof will be omitted for brevity.

In the first embodiment, as shown in FIGS. 7A and 7B, the second shutter 84 and the third shutter 93, each of which is configured to rotate about an axis defined on one side end thereof, move between the open positions and close positions to open/close the second communication section 83 and the third communication section 92, respectively, so that the process-side conveying tube 78 and the casing-side conveying tube 79 are connected/disconnected.

According to the fourth embodiment, as shown in FIGS. 11A and 11B, the process-side conveying tube 78 has a fourth shutter 131, and the casing 2 has an expanding part 136.

The fourth shutter 131 is provided below the front end part of the lower wall of the process-side conveying tube 78. The fourth shutter 131 has a planar part 133 and a protruded part 134.

The planar part 133 is a plate-like member having a rectangular shape when viewed from the up-and-down direction. A length of the planar part 133 in the right-and-left direction is longer than the length of the second communication section 83 in the right-and-left direction. The protruded part 134 is a plate-like part protruded rightward from the right side of the planar-art 133 at a substantially central position in the front-and-rear direction. The right end portion of the protruded part 134 is located on the right side with respect to the right wall of the process-side conveying tube 78.

The fourth shutter 131 is configured to slidable in the front-and-rear direction, between the close position (see FIG. 11A) and the open position (see FIG. 11B). When the fourth shutter 131 is located at the close position, the planar part 133 closes the second communication section 83 from the below as shown in FIG. 11A. When the fourth shutter 131 is located at the open position, the planar part 133 is located on the front side with respect to the second communication section 83 (see FIG. 11B), thereby the second communication section 83 being opened. The fourth shutter 131 is urged rearward by an urging member (not shown) so as to be neutrally located at the close position.

The expanding part 136 is arranged above the casing-side conveying tube 79 when projected in the right-and-left direction. The expanding part 136 has a shape of a rectangular column protruding rightward from the inner surface of the right wall of the casing 2. The casing-side conveying tube 79 does not has a shutter, thereby the third communication section 92 is always open.

According to the fourth embodiment, there is no distinction between the inside contact position and inside spaced position, and the process unit 9 is configured to slidable between the inside position and the outside position.

When the process unit 9 is located at the inside position, the expanding part 136 contacts the rear end part of the protruding part 134 as shown in FIG. 11B. Therefore, the fourth shutter 131 is displaced on the front side (i.e., caused to be displaced against the urging force by the not-shown urging member) and the second communication section 83 is opened. As above, the process-side conveying tube 78 is connected with the casing-side the second communication section 83 communicates with the third communication section 92 communicate with each other.

In order to exchange the developing cartridge 15, the user may draw the process unit 9 from the inside position to the outside position as in the first embodiment. As the process unit 9 moves frontward from the inside position, a contact condition between the protruding part 134 and the expanding part 136 is released. Then, due to the urging force by the not-shown urging member, the fourth shutter 131 moves rearward. Specifically, the fourth shutter 131 is located at the close position at which the fourth shutter 131 closes the second communication section 83. Thereafter, by the similar operation as in the first embodiment, the movement of the process unit 9 from the inside position to the outside position is completed and the developing cartridges 15 can be exchanged.

In order to return the process unit 9 from the outside position to the inside position, the same operation as taken in the first embodiment is to be taken. During the above operation, the protruding part 134 contacts the expanding part 136 from the front. Then, the fourth shutter 131 moves frontward, against the urging force applied by the not-shown urging member, and is located at the open position for opening the second communication section 83. Thereafter, by the similar operation as in the first embodiment, the developing cartridges 15 can be exchanged. Exchanging of belt cleaning unit 63 can also be exchanged as in the first embodiment, and the description thereof will be omitted for brevity.

Further, according to the fourth embodiment, effects similar to those obtained in the first and third embodiments can be obtained.

It is noted that the above-described embodiments are only exemplary ones and the invention should not be limited to the described embodiments. Rather, various modifications can be made without departing from the scope of the invention.

For example, in the foregoing description, the printer 1 is described as a color printer. It is of course possible to employ a monochromatic printer (e.g., a black and white printer) instead of the color printer. In such a modifications, similar effects as in the first embodiment can be obtained.

What is claimed is:

1. An image forming apparatus configured to form an image on a first photoconductive drum and a second photoconductive drum, the first photoconductive drum and the second photoconductive drum being arranged in a first direction, the image forming apparatus comprising:

a main body;

a belt unit configured to accommodate a belt, a belt cleaning member and an accommodating unit, the belt cleaning member being configured to remove waste toner adhered on the belt, the accommodating unit being configured to accommodate the waste toner removed by the belt cleaning member; and a drum unit configured to be movable between an inside position which is inside the main body and an outside position which is outside the main body, the drum unit comprising:

a first drum cleaning member configured to remove waste toner adhered on the first photoconductive drum, a second drum cleaning member configured to remove waste toner adhered on the second photoconductive drum, and a drum-side conveying tube extending in the first direction, the drum-side conveying tube including:

a first hole for receiving the waste toner removed by the first drum cleaning member from the first photoconductive drum;

a second hole for receiving the waste toner removed by the second drum cleaning member from the second photoconductive drum;

a third hole; and a conveying unit screw configured to convey the waste toner received through the first hole and the waste toner received through the second hole to the third hole along the first direction, wherein:

the main body comprises a casing-side conveying unit configured to receive the waste toner conveyed by the conveying unit screw through the third hole and convey the waste toner received through the third hole to the accommodating unit, communication between the drum-side conveying tube and the casing-side conveying unit is enabled in association with movement of the drum unit from the outside position to the inside position, communication between the drum-side conveying tube and the casing-side conveying unit is disabled in association with movement of the drum unit from the inside position to the outside position, the drum unit has a first shutter configured to enable and disable communication between the drum-side conveying tube and the casing-side conveying unit by being movable between an opened position at which the third hole is opened and a closed position at which the third hole is closed, and the first shutter being configured to move from the closed position to the opened position in association with movement of the drum unit in the first direction when moving from the outside position to the inside position.

2. The image forming apparatus according to claim 1, wherein:

the casing-side conveying unit has a fourth hole which communicates with the third hole when the drum unit is located at the inside position;

the casing-side conveying unit has a second shutter configured to be movable between an opened position at which the fourth hole is opened and a closed position at which the fourth hole is closed; and the second shutter moves from the closed position to the opened position in association with movement of the drum unit in the first direction when moving from the outside position to the inside position.

3. The image forming apparatus according to claim 1, further comprising:

a connecting member which is configured to connect the drum-side conveying tube and the casing-side conveying unit, wherein:

the connecting member is provided such that one connecting member is provided for the first photoconductive drum and the second photoconductive drum.

4. The image forming apparatus according to claim 3, wherein:

the drum unit is configured to move between a contact position where the first photoconductive drum and the second photoconductive drum contact the belt and a spaced position where the first photoconductive drum and the second photoconductive drum are spaced from the belt; and the drum-side conveying unit and the connecting member are configured to be connected when the drum unit is moved from the spaced position to the contact position and disconnected when the drum unit is moved from the contact position to the spaced position.

5. The image forming apparatus according to claim 3, wherein:

the drum unit is configured to slidably moved between the inside position and the outside position; and the drum-side conveying tube and the connecting member are configured to be connected in association with slidable movement of the drum unit from the outside position to the inside position, and disconnected in association with slidable movement of the drum unit from the inside position to the outside position.

6. The image forming apparatus according to claim 3, wherein the drum-side conveying unit is arranged to overlap the first and second photoconductive drums when viewed along an axial direction, the axial direction being a direction in which axes of the first and second photoconductive drums extend, the axial direction is perpendicular to the first direction.

7. The image forming apparatus according to claim 3, wherein the connecting member is arranged at a downstream position along a direction in which the drum unit moves from the inside position to the outside position in the main body.

8. The image forming apparatus according to claim 3, wherein:

the connecting member is supported by the main body; and a collecting member is configured to be detachably attached to the connecting member.

9. An image forming apparatus comprising:

a casing including a casing-side tube, the casing-side tube including an casing-side opening;

a transferring unit provided in the casing, the transferring unit including:

a belt;

a belt cleaning unit configured to remove toner from the belt; and an accommodating unit configured to accommodate toner removed from the belt by the belt cleaning unit; and a process unit movable in a first direction between an inside position which is inside the casing and an outside position which is outside the casing, the process unit including:

a first photoconductive drum, the first photoconductive drum contacting the belt of the transferring unit when the process unit is positioned at the inside position;

a first drum cleaning unit configured to remove toner from the first photoconductive drum;

a second photoconductive drum arranged with the first photoconductive drum in the first direction, the second photoconductive drum contacting the belt of the transferring unit when the process unit is positioned at the inside position;

a second drum cleaning unit configured to remove toner from the second photoconductive drum; and a drum-side tube for conveying toner removed from the first photoconductive drum by the first drum cleaning unit and toner removed from second photoconductive drum by the second drum cleaning unit to the casing-side tube, the drum-side tube extending in the first direction, the casing-side tube being configured to receive toner conveyed by the drum-side tube, the accommodating unit of the transferring unit being configured to accommodate toner received by the casing-side tube, the drum-side tube including:

a drum-side opening communicating with the casing-side opening when the process unit is positioned at the inside position, the casing-side tube being configured to receive toner conveyed by the drum-side tube through the drum-side opening and the casing-side opening, and a drum-side shutter movable between an opened position at which the drum-side opening is opened and a closed position at which the drum-side opening is closed, the drum-side shutter being configured to move from the closed position to the opened position in accordance with movement of the process unit from the outside position to the inside position to allow the drum-side opening to communicate with the casing-side opening, the drum-side shutter being configured to move from the opened position to the closed position in accordance with movement of the process unit from the inside position to the outside position.

10. The image forming apparatus according to claim 9, wherein the casing includes a pressing part, the process unit receiving an urging force applied from the pressing part when the process unit moves from the outside position to the inside position, and wherein the drum-side shutter moves from the closed position to the opened position by the urging force applied from the pressing part.

11. The image forming apparatus according to claim 9, wherein the casing includes a guide rail, the guide rail including a first section extending in the first direction, and wherein the process unit includes a positioning shaft, the positioning shaft sliding on the first section when the process unit moves between the inside position and the outside position.

12. The image forming apparatus according to claim 9, wherein the process unit includes a process frame supporting the first photoconductive drum and the second photoconductive drum, wherein the process frame includes a first wall and second wall, the first wall and the second wall extending in the first direction, the first photoconductive drum and the second photoconductive drum being supported between the first wall and second wall, and wherein the drum-side tube is supported on the first wall of the process frame.

13. The image forming apparatus according to claim 9, wherein the casing-side tube has a casing-side shutter movable between an opened position at which the casing-side opening is opened and a closed position at which the casing-side opening is closed, and wherein the casing-side shutter is movable from the closed position to the opened position in association with movement of the process unit from the outside position to the inside position and the casing-side shutter is movable from the opened position to the closed position in association with movement of the process unit from the inside position to the outside position.

14. The image forming apparatus according to claim 9, wherein the process unit is movable between a contact position where the first photoconductive drum and second photoconductive drum contact the belt and a spaced position where the first photoconductive drum and the second photoconductive drum are spaced from the belt, and wherein the drum-side shutter moves from the closed position to the opened position when the process unit moves from the spaced position to the contact position and the drum-side shutter moves from the opened position to the closed position when the process unit moves from the contact position to the spaced position.

15. The image forming apparatus according to claim 14, wherein the casing includes a guide rail, the guide rail including a first section extending in the first direction and a second section being inclined from the first section, and wherein the process unit includes a positioning shaft, the positioning shaft sliding on the second section when the process unit moves from the spaced position to the contact position.

16. The image forming apparatus according to claim 9, wherein the casing-side tube extends in a second direction perpendicular to the first direction.

17. The image forming apparatus according to claim 16, wherein the drum-side tube extends in a horizontal direction and the casing-side tube extends in a vertical direction.

18. The image forming apparatus according to claim 9, wherein the first photoconductive drum is rotatable about an axis, and wherein the drum-side tube is arranged to overlap the first photoconductive drum and the second photoconductive drum when viewed from a direction in which the axis of the first photoconductive drum extends.

* * * * *